US010662609B2

(12) United States Patent
Hallale et al.

(10) Patent No.: US 10,662,609 B2
(45) Date of Patent: May 26, 2020

(54) HYBRID LOADER BOOM ARM ASSEMBLY

(71) Applicant: Deere & Company, Moline, IL (US)

(72) Inventors: Sanjeev M. Hallale, Pune (IN); Mohamad S. El-Zein, Bettendorf, IA (US); Hector Portillo, Monterrey (MX); Israel Priego, Augusta, GA (US); Daniel Chapa, Monterrey (MX); Sathish Kumar Sivaraman, Pune (IN)

(73) Assignee: Deere & Company, Moliine, IL (US)

( * ) Notice: Subject to any disclaimer, the term of this patent is extended or adjusted under 35 U.S.C. 154(b) by 234 days.

(21) Appl. No.: 15/950,900

(22) Filed: Apr. 11, 2018

(65) Prior Publication Data

US 2019/0316317 A1 Oct. 17, 2019

(51) Int. Cl.

| | |
|---|---|
| ***E02F 3/34*** | (2006.01) |
| ***E02F 3/38*** | (2006.01) |
| ***E02F 3/36*** | (2006.01) |

(52) U.S. Cl.

CPC ..... *E02F 3/382* (2013.01); *E02F 3/34* (2013.01); *E02F 3/369* (2013.01); *E02F 3/38* (2013.01)

(58) Field of Classification Search

CPC .. B66C 23/70; E02F 3/34; E02F 3/369; E02F 3/38; E02F 3/382

USPC ..... 414/685, 686, 722, 727; 403/292, 293, 403/295

See application file for complete search history.

(56) References Cited

U.S. PATENT DOCUMENTS

| | | | | |
|---|---|---|---|---|
| 3,722,864 | A | 3/1973 | Borer et al. | |
| 4,576,543 | A * | 3/1986 | Kuchyt | A01D 87/0069 414/685 |
| 4,904,151 | A * | 2/1990 | Biemans | E02F 3/34 172/817 |
| 5,152,659 | A * | 10/1992 | Waka | E02F 3/38 212/347 |

(Continued)

FOREIGN PATENT DOCUMENTS

| | | | |
|---|---|---|---|
| DE | 102015209918 | A | 12/2016 |
| EP | 1387012 | A2 | 2/2004 |

(Continued)

OTHER PUBLICATIONS

European Search Report issued in counterpart application No. 19163533.3, dated Aug. 19, 2019, 8 pages.

(Continued)

*Primary Examiner* — Saul Rodriguez
*Assistant Examiner* — Brendan P Tighe
(74) *Attorney, Agent, or Firm* — Tucker Ellis LLP

(57) ABSTRACT

A hybrid loader boom arm assembly for a loader work vehicle includes an arm assembly that includes a first beam formed from a lightweight material and a second beam formed from the lightweight material. The loader boom arm includes a connection assembly having a first steel plate and a pair of knee plates formed from the lightweight material. A portion of the first steel plate is received within the first beam and a second portion of the first steel plate is received within the second beam. The pair of knee plates cooperate to define a first channel that receives the end of the first beam and a second channel that receives the second end of the second beam. The first steel plate and the pair of knee plates are configured for interconnecting the first beam with the second beam.

20 Claims, 17 Drawing Sheets

(56) References Cited

U.S. PATENT DOCUMENTS

| | | | | |
|---|---|---|---|---|
| 5,316,709 | A | 5/1994 | Ko et al. | |
| 6,572,323 | B2 | 6/2003 | Schupback | |
| 6,695,568 | B2 | 2/2004 | Bares et al. | |
| 7,001,133 | B2 * | 2/2006 | Muramoto | E02F 3/382 172/275 |
| D584,749 | S * | 1/2009 | Smith | D15/28 |
| 8,505,258 | B2 | 8/2013 | Durney | |
| 8,708,171 | B2 | 4/2014 | Schmidt et al. | |
| 8,974,172 | B2 | 3/2015 | Nishi | |
| 9,546,498 | B2 | 1/2017 | Britt, Jr. | |
| 2006/0182597 | A1 * | 8/2006 | Higashikawa | E02F 3/34 414/722 |
| 2006/0182598 | A1 * | 8/2006 | Fukudome | E02F 3/34 414/722 |
| 2007/0224027 | A1 * | 9/2007 | Nishi | E02F 3/38 414/722 |
| 2010/0158653 | A1 * | 6/2010 | Webb | E02F 3/34 414/722 |
| 2012/0177471 | A1 | 7/2012 | Valentini et al. | |
| 2013/0017049 | A1 * | 1/2013 | Nishi | E02F 3/34 414/727 |
| 2014/0079523 | A1 | 3/2014 | Jensen et al. | |
| 2015/0003949 | A1 | 1/2015 | Kusama | |
| 2015/0090850 | A1 | 4/2015 | Maini et al. | |
| 2019/0316315 | A1 * | 10/2019 | Hallale | E02F 3/382 |

FOREIGN PATENT DOCUMENTS

| | | | |
|---|---|---|---|
| KR | 20070008814 | A | 1/2007 |
| KR | 20090085411 | A | 8/2009 |
| KR | 20140100675 | A | 8/2014 |
| WO | 9904104 | A1 | 1/1999 |
| WO | 2009094727 | A1 | 8/2009 |

OTHER PUBLICATIONS

European Search Report issued in related application No. 19163524.2, dated Aug. 19, 2019, 8 pages.

* cited by examiner

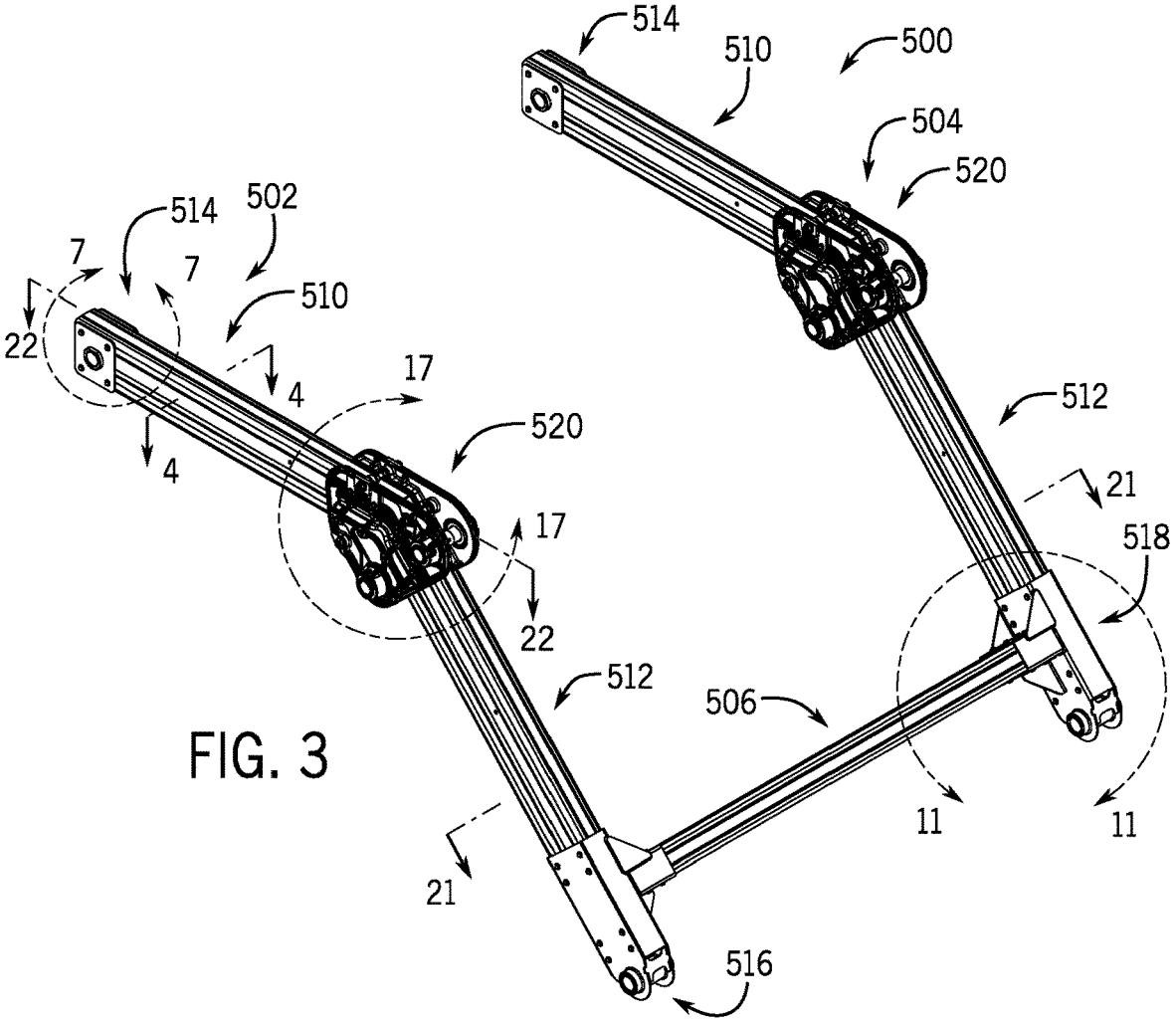
FIG. 3
FIG. 5
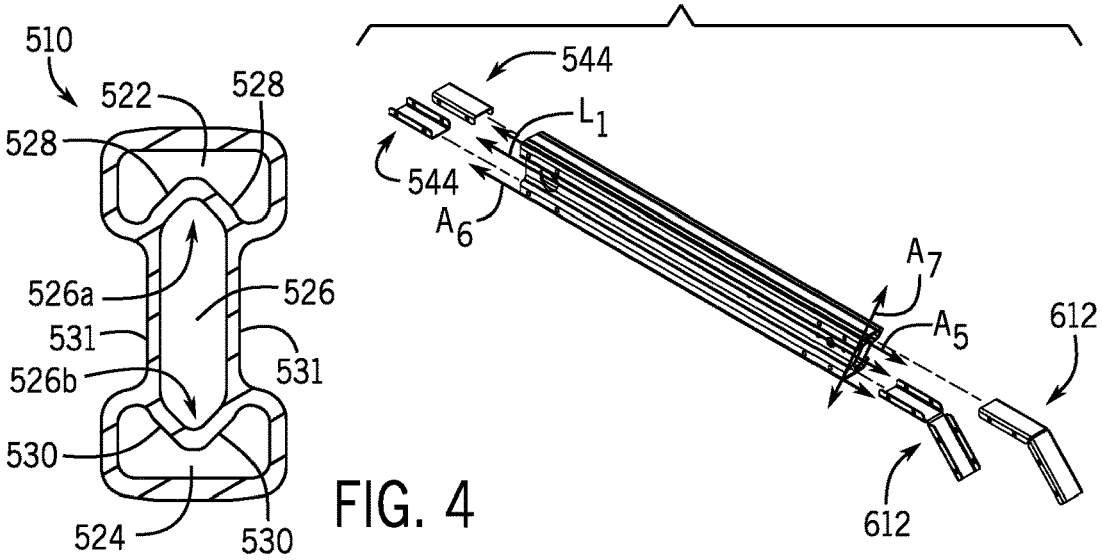
FIG. 4

HYBRID LOADER BOOM ARM ASSEMBLY

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles, such as loaders, and boom arm assemblies that are configured to attach a work implement, such as a bucket, to the work vehicles to carry material.

BACKGROUND OF THE DISCLOSURE

In the agriculture, construction and forestry industries, various work machines, such as loaders, may be utilized in lifting and moving various materials. In certain examples, a loader may include a bucket pivotally coupled by a loader boom arms to the vehicle chassis. One or more hydraulic cylinders move the loader boom arms and/or the bucket to move the bucket between positions relative to the chassis to lift and move materials.

Various factors are considered when designing or selecting the loader boom arms and bucket arrangement used, for example, the durability and wear resistance of the loader boom arms, and the weight of material the loader boom arms can lift. These factors typically indicate that the loader boom arms be made of heavy steel plate construction to handle large volumes of material and the corresponding weight and other forces associated with loading and carrying the heavy material. This also requires a robust hydraulic system with correspondingly large-capacity pumps, accumulators, valves and cylinders. Further, wear or damage to the loader boom arms may also require replacement or vehicle downtime to repair the heavy-duty components.

SUMMARY OF THE DISCLOSURE

The disclosure provides a hybrid loader boom arm assembly in which an arm assembly and a second arm assembly formed of a lightweight material are interconnected by a torque transfer tube formed of a lightweight material.

In one aspect, the disclosure provides a hybrid loader boom arm assembly for a loader work vehicle. The loader boom arm includes an arm assembly that includes a first hollow beam formed from a lightweight material and a second hollow beam formed from the lightweight material. The loader boom arm includes a connection assembly having a first steel plate and a pair of knee plates formed from the lightweight material. A portion of the first steel plate is received within the first beam at an end and a portion of the first steel plate is received within the second beam at a second end. The pair of knee plates cooperate to define a first channel that receives the end of the first beam and a second channel that receives the second end of the second beam such that the end of the first beam and the second end of the second beam are between the pair of knee plates. The first steel plate and the pair of knee plates are configured for interconnecting the first beam with the second beam.

Further provided is a method for assembling a hybrid loader boom arm for a loader work vehicle. The method includes coupling a first steel plate within an end of a first hollow beam formed from a lightweight material and within a second end of a second hollow beam formed from the lightweight material to form an arm assembly. The method includes coupling a first knee plate to the end of the first hollow beam and to the second end of the second hollow beam. The first knee plate defines a first channel portion that receives a portion of the end of the first hollow beam and a second channel portion that receives a portion of the second end of the second hollow beam. The method includes coupling a second knee plate to the end of the first hollow beam and to the second end of the second hollow beam. The second knee plate defines a third channel portion that receives a second portion of the end of the first hollow beam and a fourth channel portion that receives a second portion of the second end of the second hollow beam. The method includes interconnecting the first knee plate and the second knee plate.

Also provided is a hybrid loader boom arm assembly kit for a loader work vehicle. The kit includes a first hollow beam formed from a lightweight material, and a second hollow beam formed from the lightweight material. The kit includes a first steel plate configured to be received within an end of the first beam and a second end of the second beam. The kit includes a pair of knee plates formed from the lightweight material configured to receive the end of the first beam and the second end of the second beam.

The details of one or more embodiments are set forth in the accompanying drawings and the description below. Other features and advantages will become apparent from the description, the drawings, and the claims.

BRIEF DESCRIPTION OF THE DRAWINGS

FIG. 3 is a perspective view of the example hybrid loader boom arm assembly for use with the work vehicle of FIG. 1 or FIG. 1A;

FIG. 4 is a cross-sectional view of the first beam of the one of the arm assemblies of the hybrid loader boom arm assembly of FIG. 3, taken along line 4-4 of FIG. 3;

FIG. 5 is an exploded view of a first beam of one of the arm assemblies of the hybrid loader boom arm assembly of FIG. 3;

Like reference symbols in the various drawings indicate like elements.

DETAILED DESCRIPTION

Figure 1:
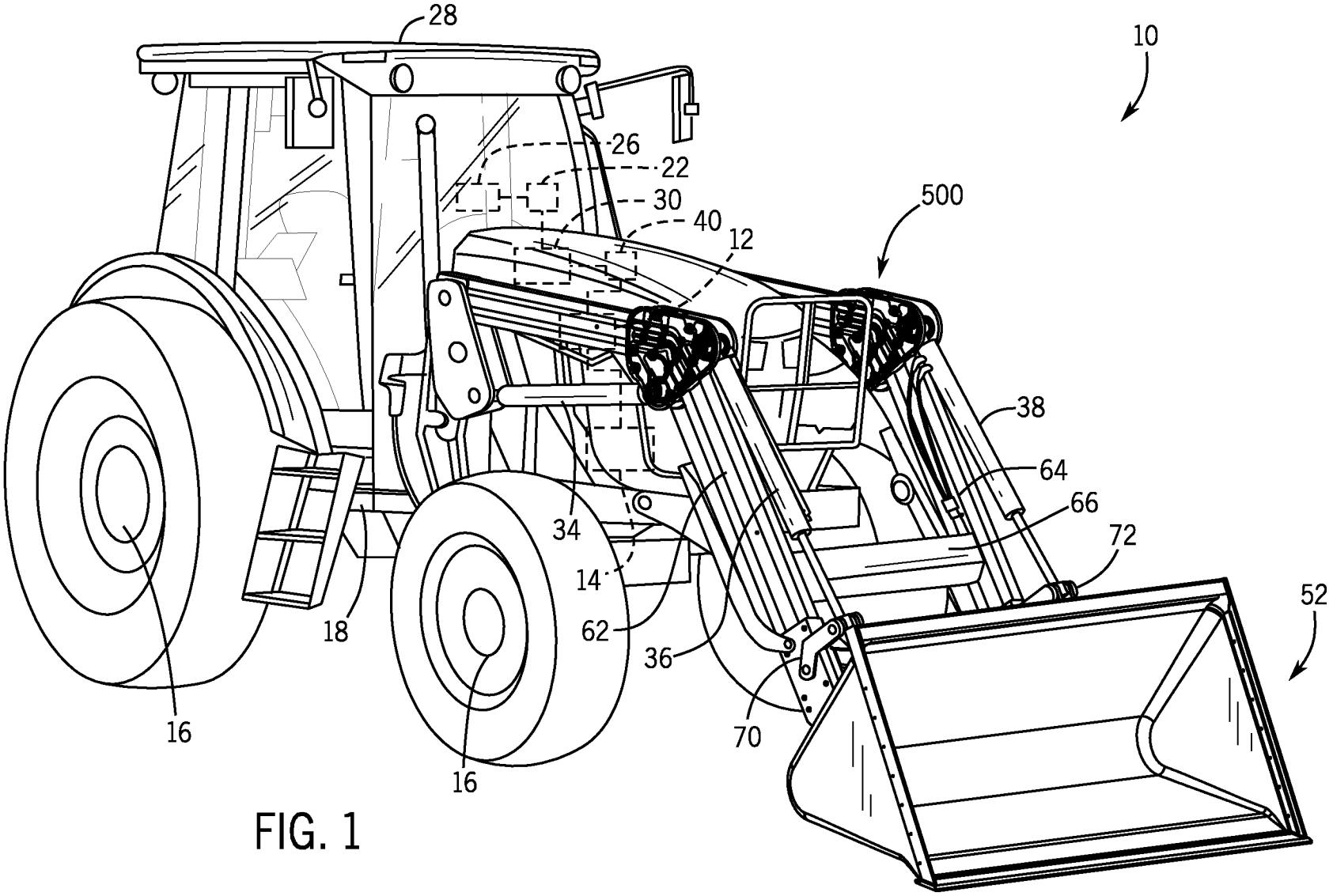
FIG. 1 is a perspective view of an example work vehicle in the form of an agricultural loader in which the disclosed hybrid loader boom arm assembly may be used.

The following describes one or more example embodiments of the disclosed hybrid loader boom arm assembly, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Conventional loader boom arms for use in various construction and agricultural applications to couple a work implement to a work vehicle for hauling materials (e.g., dirt, sand, aggregate and so on) are typically cast or fabricated of heavy-duty construction using high-strength materials (e.g., steel). The heavy-duty construction affords conventional loader boom arms the ability to undergo extreme lifting and treatment during use. In addition to the material itself, the weight of the heavy-duty loader boom arms must be accommodated by the host machine, and specifically by its hydraulic system, to ensure that the machine performs as expected, that is will raise and lower the loader boom arms at the rate and range of motion desired. Further, as heavy and rugged as they are, encountering sufficient loading, abrasion or other forces can cause damage to conventional loader boom arms. The loader boom arms may yield (i.e., crack) due to impact or stress concentrations, or they may experience wear that may impact the performance of the machine. Damage or worn loader boom arms may need to be replaced or repaired at significant expense or operational downtime of the machine.

This disclosure provides an alternative to the conventional loader boom arms through the use of a hybrid loader boom arm assembly that is configured to couple to the work vehicle and the bucket. The disclosed hybrid loader boom arm assembly has a light-duty construction, and is composed of generally lightweight materials. For example, the disclosed hybrid loader boom arm assembly ("HLBAA") may have arm assemblies composed of a first beam, a second beam and a torque transfer tube, each of which is composed of a lightweight material. As used herein "lightweight material" generally denotes a material that has a weight that is less than a weight of steel, such that an arm assembly of the HLBAA has a weight that is less than a weight of a conventional steel arm assembly. Exemplary lightweight materials include, but are not limited to, aluminum, polymer-based material, glass-fiber reinforced polymer-based materials, carbon-fiber reinforced polymer-based materials, G10 material, and the like. The HLBAA generally has a weight that is about 10% to about 20% lighter than conventional steel loader boom arms. This reduces fuel consumption, and may enable the use of a light-duty hydraulic system. In this way, the disclosed HLBAA may have both lightweight and low-cost attributes.

Generally, the lightweight construction of the HBLAA enables the HBLAA to be packaged in regular packaging, and transported in a disassembled state, which reduces shipping and transportation costs. The HBLAA may be assembled at the customer's location or other location remote from the manufacturing facility, which increases a volume of HBLAA that may be transported in a transportation vehicle, for example. In this regard, the HBLAA may be packaged in containers, for example, which may be stacked within the transportation vehicle. Generally, the HBLAA is assembled with a plurality of blind oversized mechanical (BOM) fasteners, which enable the customer to assemble the HBLAA at their desired location. Once the HBLAA is assembled, in order to disassemble the HBLAA, special tools, such as drills, may be used to remove the BOM fasteners to replace damaged parts, for example.

Figure 2:
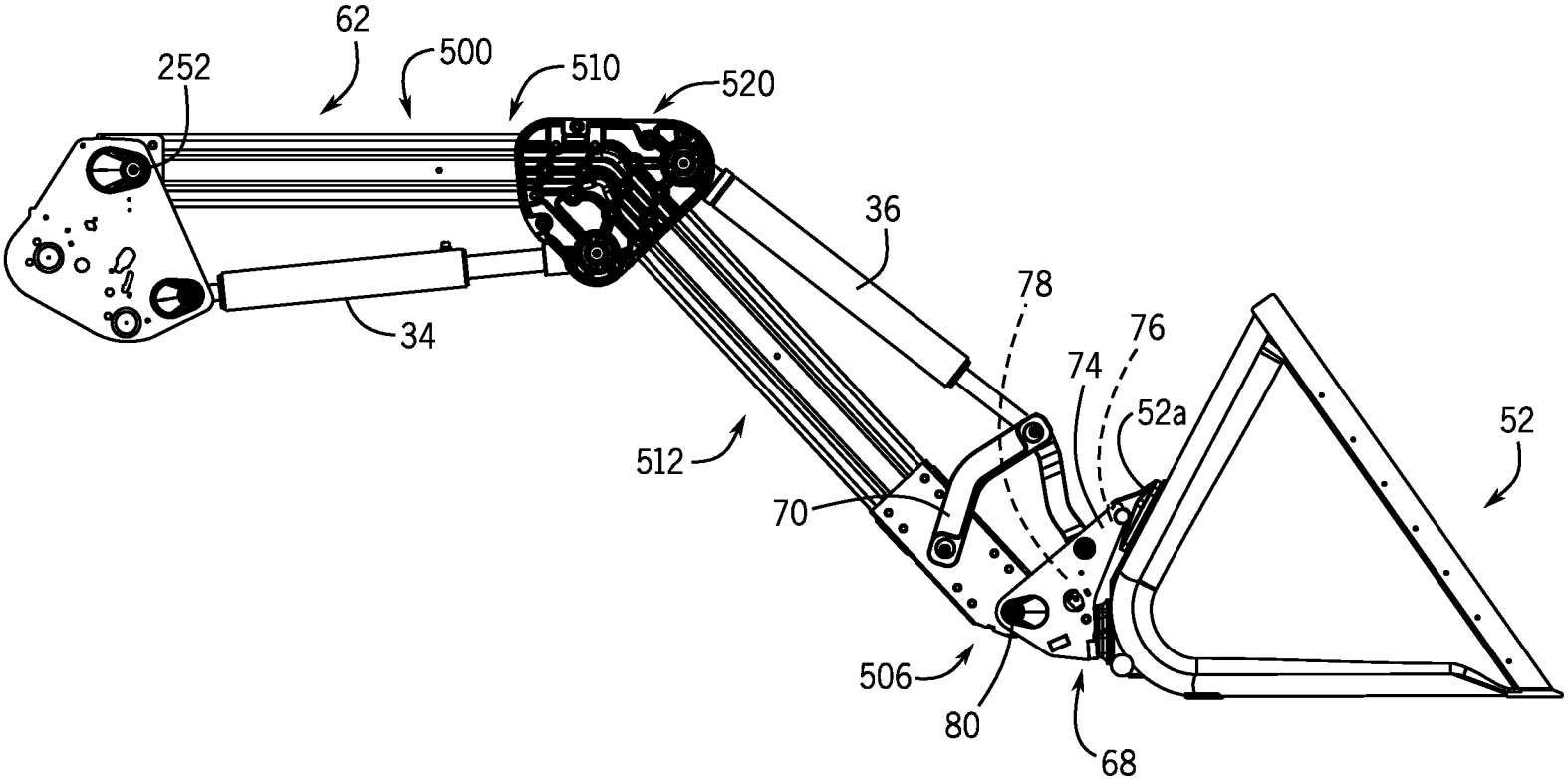
FIG. 2 is a side view of an example hybrid loader boom arm assembly coupled to a bucket as shown in FIG. 1.

The following describes one or more example implementations of the disclosed HLBAA. The HLBAA may be utilized with various machines or work vehicles, including loaders and other machines for lifting and moving various materials in the agricultural and construction industries. Referring to FIGS. 1 and 2, in some embodiments, the HLBAA may be used with an agricultural loader 10. It will be understood that the configuration of the loader 10 is presented as an example only. In this regard, the disclosed HLBAA may be implemented as a front loader removably coupled to a work vehicle, such as a tractor. Other work vehicles, such as dedicated wheel loaders used in the construction industry, may benefit from the disclosed HLBAA as well. Further, the HLBAA may be used with a skid-steer or other work vehicles that employ one or more boom arms to couple work implements to the work vehicle.

Generally, the loader 10 includes a source of propulsion, such as an engine 12 that supplies power to a transmission 14. In one example, the engine 12 is an internal combustion engine, such as a diesel engine, that is controlled by an engine control module. The transmission 14 transfers power from the engine 12 to a suitable driveline coupled to one or more driven wheels 16 of the loader 10 to enable the loader 10 to move. The engine 12, the transmission 14 and the rest of the driveline are supported by a vehicle chassis 18, which is supported off the ground by the wheels 16. As is known to one skilled in the art, the transmission 14 can include a suitable gear transmission, which can be operated in a variety of ranges containing one or more gears, including, but not limited to a park range, a neutral range, a reverse range, a drive range, a low range, a high range, etc. The transmission 14 may be controlled by a transmission control module, which is, along with the engine control module, in communication with a master controller 22 (or group of controllers).

The controller 22 may control various aspects of the operation of the loader 10 and may be configured as a computing device with associated processor devices and memory architectures, as a hard-wired computing circuit (or circuits), as a programmable circuit, as a hydraulic, electrical or electro-hydraulic controller, or otherwise. As such, the controller 22 may be configured to execute various computational and control functionality with respect to the loader 10 (or other machinery). In some embodiments, the controller 22 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 22 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 22 may be in electronic, hydraulic, mechanical, or other communication with various other systems or devices of the loader 10 (or other machinery). For example, the controller 22 may be in electronic or hydraulic communication with various actuators, sensors, and other devices within (or outside of) the loader 10, including various devices associated with a hydraulic system. The controller 22 may communicate with other systems or devices (including other controllers) in various known ways, including via a CAN bus (not shown) of the loader 10, via wireless or hydraulic communication means, or otherwise. An example location for the controller 22 is depicted in FIG. 1. It will be understood, however, that other locations are possible including other locations on the loader 10, or various remote locations. In some embodiments, the controller 22 may be configured to receive input commands and to interface with an operator via a human-machine interface 26, which may be disposed inside a cab 28 of the loader 10 for easy access by the operator. The human-machine interface 26 may be configured in a variety of ways and may include one or more joysticks, various switches or levers, one or more buttons, a touchscreen interface that may be overlaid on a display, a keyboard, a speaker, a microphone associated with a speech recognition system, or various other human-machine interface devices.

The loader 10 also has a hydraulic system that includes one or more pumps and accumulators (designated generally by reference number 30), which may be driven by the engine 12 of the loader 10. Flow from the pumps 30 may be routed through various control valves and various conduits (e.g., flexible hoses) to drive various hydraulic cylinders, such as hydraulic cylinders 34, 36, 38, shown in FIG. 1. Flow from the pumps (and accumulators) 30 may also power various other components of the loader 10. The flow from the pumps 30 may be controlled in various ways (e.g., through control of various electro-hydraulic control valves 40) to cause movement of the hydraulic cylinders 34, 36, 38, and thus, a HLBAA 500 relative to the loader 10. In this way, for example, movement of the HLBAA 500 between various positions relative to the chassis 18 of the loader 10 may be implemented by various control signals to the pumps 30, control valves 40, and so on.

In the embodiment depicted, a bucket 52 is pivotally mounted to the HLBAA 500. The bucket 52 may comprise a conventional steel bucket, or may comprise a hybrid loader bucket assembly. As will be discussed in greater detail herein, the HLBAA 500 includes a first or arm assembly 502 and a second arm assembly 504, which are interconnected via a hollow torque transfer tube 506 to operate in parallel. The arm assemblies 502, 504 are each coupled to the chassis 18, directly or via another frame portion of the loader 10, at one end, and are coupled at an opposite end to the bucket 52 via a carrier 68, which is pivoted via first and second (left and right) pivot linkages 70, 72. In the illustrated example, the carrier 68 comprises first and second (left and right) couplers 74, 76, connected by a cross-rod 78, that mount to the distal ends of the respective arm assemblies 502, 504 via coupling pins 80. Additional pins pivotally couple the pivot linkages 70, 72 between the arm assemblies 502, 504 and the respective first and second couplers 74, 76. The pivot linkages 70, 72 enable pivotal movement of the bucket 52 upon actuation of the hydraulic cylinders 36, 38.

The hydraulic cylinders may be actuated to raise and lower the HLBAA 500 relative to the loader 10. In the illustrated example, the HLBAA 500 includes two hydraulic cylinders, namely the hydraulic cylinder 34 coupled between the chassis 18 and the arm assembly 502 and a corresponding cylinder on the opposite side of the loader (not shown) coupled between the chassis 18 and the second arm assembly 504. It should be noted that the loader 10 may have any number of hydraulic cylinders, such as one, three, etc. Each of the hydraulic cylinders 34 includes an end coupled to the chassis 18 (e.g., via a coupling pin) and an end mounted to the respective one of the arm assembly 502 and the second arm assembly 504 (e.g., via another pin). Upon activation of the hydraulic cylinders 34, the HLBAA 500 may be moved between various positions to elevate the HLBAA 500, and thus the bucket 52, relative to the chassis 18 of the loader 10.

One or more hydraulic cylinders 36 are mounted to the arm assembly 502 and the first pivot linkage 70, and one or more hydraulic cylinders 38 are mounted to the second arm assembly 504 and the second pivot linkage 72. In the illustrated example, the loader 10 includes a single hydraulic cylinder 36, 38 associated with a respective one of the arm assembly 502 and the second arm assembly 504, respectively. Each of the hydraulic cylinders 36, 38 includes an end mounted to the respective one of the arm assembly 502 and the second arm assembly 504 (via another pin) and an end mounted to the respective one of the first pivot linkage 70 and the second pivot linkage 72 (via another pin). Upon activation of the hydraulic cylinders 36, 38, the bucket 52 may be moved between various positions, namely to pivot the carrier 68, and thereby the bucket 52, relative to the HLBAA 500.

Thus, in the embodiment depicted, the bucket 52 is pivotable about the carrier 68 of the HLBAA 500 by the hydraulic cylinders 36, 38. As noted, in some embodiments, a different number or configuration of hydraulic cylinders or other actuators may be used. Thus, it will be understood that the configuration of the hydraulic system and the HLBAA 500 is presented as an example only. In this regard, in other contexts, a hoist boom (e.g. the HLBAA 500) may be generally viewed as a boom that is pivotally attached to a vehicle frame, and that is also pivotally attached to an end effector (e.g., the bucket 52). Similarly, the carrier 68 (e.g., the couplers 74, 76) may be generally viewed as a component effecting pivotal attachment of a bucket (e.g. the bucket 52) to a vehicle frame. In this light, a tilt actuator (e.g., the hydraulic cylinders 36, 38) may be generally viewed as an actuator for pivoting a receptacle with respect to a hoist boom, and the hoist actuator (e.g. the hydraulic cylinders 34) may be generally viewed as an actuator for pivoting a hoist boom with respect to a vehicle frame.

In certain applications, sensors (e.g., pressure, flow or other sensors) may be provided to observe various conditions associated with the loader 10. For example, the sensors may include one or more pressure sensors that observe a pressure within the hydraulic circuit, such as a pressure associated with at least one of the pumps 30, the control valves 40 and/or one or more hydraulic cylinders 34, 36, 38 to observe a pressure within the hydraulic cylinders and generate sensor signals based thereon. In some cases, various sensors may be disposed on or near the carrier 68 and/or the bucket 52. For example, sensors (e.g. inertial measurement sensors) may be coupled on or near the bucket 52 to observe or measure parameters including the acceleration of the HLBAA 500 and/or the bucket 52 and generate sensor signals, which may indicate if the HLBAA 500 and/or the bucket 52 is accelerating or decelerating. In some embodiments, various sensors (e.g., angular position sensors) may be configured to detect the angular orientation of the bucket 52 relative to the HLBAA 500, or to detect the angular orientation of the HLBAA 500 relative to the chassis 18, and various other indicators of the current orientation or position of the bucket 52. For example, rotary angular positon sensors may be used or linear position or displacement sensors may be used to determine the length of the hydraulic cylinders 34, 36, 38 relative to the HLBAA 500.

The bucket 52 generally defines a receptacle for carrying various materials, such as dirt, rocks, wet dirt, sand, hay, etc. In one example, the bucket 52 may receive about two cubic yards of material to over about five cubic yards of material. The bucket 52 is movable upon actuation of the hydraulic cylinders 36, 38 between a level position, a roll-back position and a dump position, along with various positions in between. In the level position, the bucket 52 can receive various materials. In the roll-back position, the bucket 52 is pivoted upward relative to the earth's surface or ground by the actuation of the hydraulic cylinders 36, 38 such that the bucket 52 may be loaded with and retain the various materials. In the dump position, the bucket 52 is pivoted downward relative to the earth's surface or ground by the actuation of the hydraulic cylinders 36, 38 such that the various materials may fall from the bucket 52 to substantially empty the bucket 52.

Figure 1A:
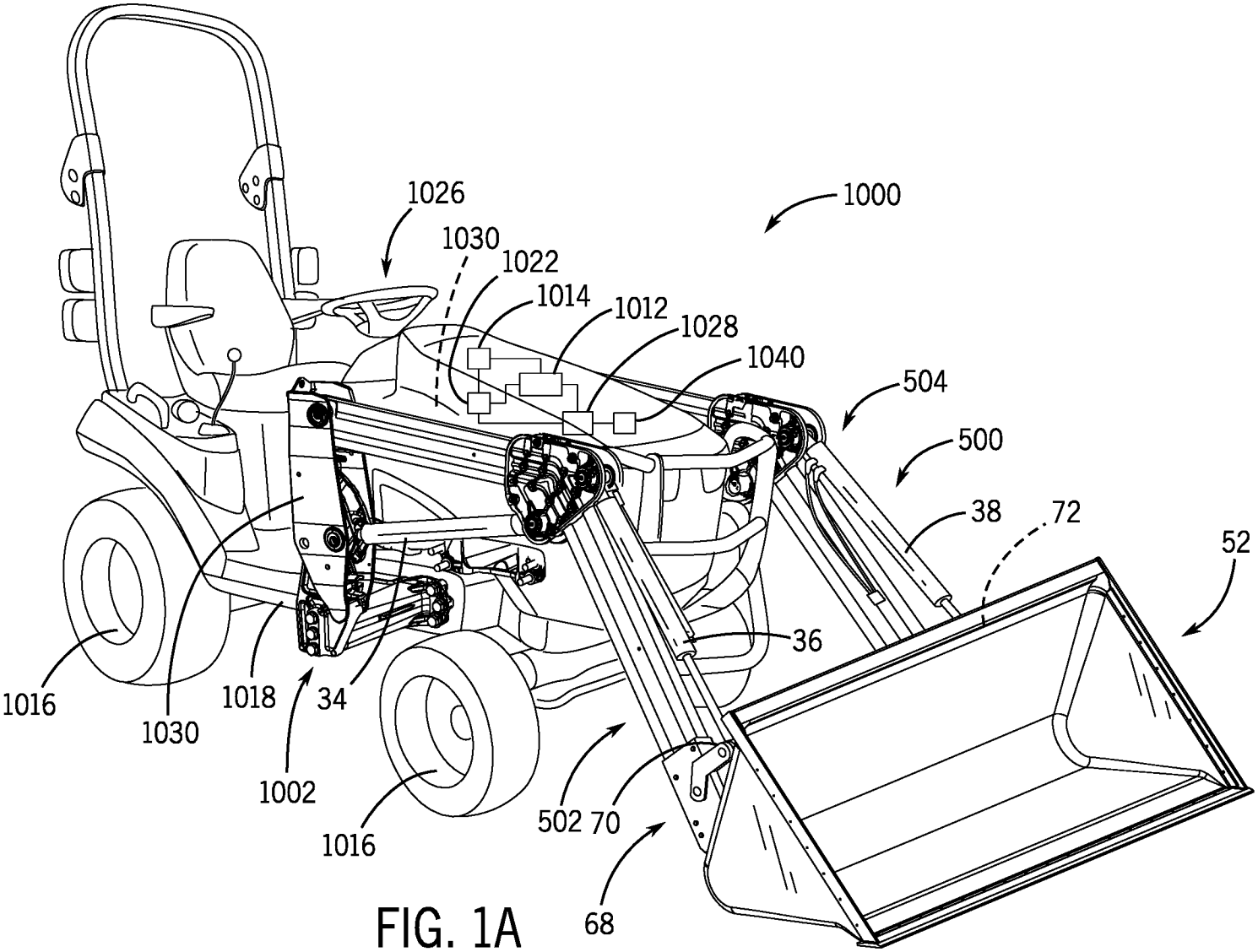
FIG. 1A is a perspective view of an example work vehicle in the form of a compact utility tractor in which the disclosed hybrid loader boom arm assembly may be used.

Referring to FIG. 1A, in some embodiments, the HLBAA 500 may be used with a compact utility tractor 1000 having a front loader 1002 removably coupled to the compact utility tractor 1000. It will be understood that the implementation of the HLBAA 500 with the compact utility tractor 1000 is presented as an example only. Generally, the compact utility tractor 1000 includes a source of propulsion, such as an engine 1012 that supplies power to a transmission 1014. In one example, the engine 1012 is an internal combustion engine, such as a diesel engine, that is controlled by an engine control module. The transmission 1014 transfers power from the engine 1012 to a suitable driveline coupled to one or more driven wheels 1016 of the compact utility tractor 1000 to enable the compact utility tractor 1000 to move. The engine 1012, the transmission 1014 and the rest of the driveline are supported by a vehicle chassis 1018, which is supported off the ground by the wheels 1016. As is known to one skilled in the art, the transmission 1014 can include a suitable gear transmission, which can be operated in a variety of ranges. The transmission 1014 may be controlled by a transmission control module, which is, along with the engine control module, in communication with a master controller 1022 (or group of controllers).

The controller 1022 may control various aspects of the operation of the compact utility tractor 1000 and may be configured as a computing device with associated processor devices and memory architectures, as a hard-wired computing circuit (or circuits), as a programmable circuit, as a hydraulic, electrical or electro-hydraulic controller, or otherwise. As such, the controller 1022 may be configured to execute various computational and control functionality with respect to the compact utility tractor 1000 (or other machinery). In some embodiments, the controller 1022 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 1022 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 1022 may be in electronic, hydraulic, mechanical, or other communication with various other systems or devices of the compact utility tractor 1000 (or other machinery), including the front loader 1002. For example, the controller 1022 may be in electronic or hydraulic communication with various actuators, sensors, and other devices within (or outside of) the compact utility tractor 1000, including various devices associated with a hydraulic system of the front loader 1002. The controller 1022 may communicate with other systems or devices (including other controllers) in various known ways, including via a CAN bus (not shown) of the compact utility tractor 1000, via wireless or hydraulic communication means, or otherwise. An example location for the controller 1022 is depicted in FIG. 1A. It will be understood, however, that other locations are possible including other locations on the compact utility tractor 1000, or various remote locations. In some embodiments, the controller 1022 may be configured to receive input commands and to interface with an operator via a human-machine interface 1026, which may be disposed for easy access by the operator. The human-machine interface 1026 is in communication with the controller 1022 over a suitable communication architecture, such as a CAN bus. The human-machine interface 1026 may be configured in a variety of ways and may include one or more joysticks, various switches or levers, a steering wheel, one or more buttons, a touchscreen interface that may be overlaid on a display, a keyboard, a speaker, a microphone associated with a speech recognition system, or various other human-machine interface devices.

The compact utility tractor 1000 also has a hydraulic system that includes one or more pumps and accumulators (designated generally by reference number 1028), which may be driven by the engine 1012 of the compact utility tractor 1000. Flow from the pumps 1028 may be routed through various control valves and various conduits (e.g., flexible hoses) to drive various hydraulic cylinders, such as hydraulic cylinders 34, 36, 38 associated with the front loader 1002, shown in FIG. 1A. Flow from the pumps (and accumulators) 1028 may also power various other components of the compact utility tractor 1000. The flow from the pumps 1028 may be controlled in various ways (e.g., through control of various electro-hydraulic control valves 1040) to cause movement of the hydraulic cylinders 34, 36, 38, and thus, the front loader 1002 relative to the compact utility tractor 1000 when the front loader 1002 is mounted on the compact utility tractor 1000 through a suitable mounting arrangement. In this way, for example, movement of the front loader 1002 between various positions relative to the chassis 1018 of the compact utility tractor 1000 may be implemented by various control signals to the pumps 1028, control valves 1040, and so on.

In the embodiment depicted, the front loader 1002 includes the bucket 52 pivotally mounted to the HLBAA 500. The arm assemblies 502, 504 are each configured to be coupled to the chassis 18 via a suitable mounting arrangement, at one end, and are coupled at an opposite end to the bucket 52 via the carrier 68. The mounting arrangement may include a mast 1030 on each side of the front loader 1002 that cooperates with a mounting frame on each side of the compact utility tractor 1000 to removably couple the front loader 1002 to the compact utility tractor 1000.

As discussed with regard to FIGS. 1 and 2, the hydraulic cylinders 34 may be actuated to raise and lower the HLBAA 500 relative to the compact utility tractor 1000. In the illustrated example, the HLBAA 500 includes two hydraulic cylinders, namely the hydraulic cylinder 34 coupled between the mast 1030 of the front loader 1002 and the arm assembly 502 and a corresponding cylinder on the opposite side of the loader (not shown) coupled between the mast 1030 and the second arm assembly 504. It should be noted that the compact utility tractor 1000 may have any number of hydraulic cylinders, such as one, three, etc. Each of the hydraulic cylinders 34 includes an end coupled to the mast 1030 (e.g., via a coupling pin) and an end mounted to the respective one of the arm assemblies 502, 504 (e.g., via another pin). Upon activation of the hydraulic cylinders 34, the HLBAA 500 may be moved between various positions to elevate the HLBAA 500, and thus the bucket 52, relative to the chassis 1018 of the compact utility tractor 1000.

The one or more hydraulic cylinders 36 are mounted to the arm assembly 502 and the first pivot linkage 70, and the one or more hydraulic cylinders 38 are mounted to the second arm assembly 504 and the second pivot linkage 72. In the illustrated example, the front loader 1002 includes a single hydraulic cylinder 36, 38 associated with a respective one of the arm assemblies 502, 504, respectively. Each of the hydraulic cylinders 36, 38 includes an end mounted to a respective one of the arm assemblies 502, 504 (via a pin) and an end mounted to the respective one of the first pivot linkage 70 and the second pivot linkage 72 (via another pin). Upon activation of the hydraulic cylinders 36, 38, the bucket 52 may be moved between various positions, namely to pivot the carrier 68, and thereby the bucket 52, relative to the HLBAA 500. Thus, in the embodiment depicted, the bucket 52 is pivotable about the carrier 68 of the HLBAA 500 by the hydraulic cylinders 36, 38. As noted, in some embodiments, a different number or configuration of hydraulic cylinders or other actuators may be used. Accordingly, it will be understood that the configuration of the hydraulic system and the HLBAA 500 is presented as an example only.

Referring also to FIG. 3, the example HLBAA 500 will now be detailed. In one example, the HLBAA 500 includes an arm assembly 502, a second arm assembly 504 and a hollow torque transfer tube 506 that interconnects the arm assembly 502 and the second arm assembly 504. Each of the arm assembly 502 and the second arm assembly 504 include a first beam 510, a second beam 512, a vehicle mounting subassembly 514, a respective bucket mount bracket or bucket mount bracket subassembly 516, 518 and a knee mounting subassembly 520.

The first beam 510, the second beam 512 and the torque transfer tube 506 are each formed from the lightweight material. In one example, the first beam 510, the second beam 512 and the torque transfer tube 506 are each formed from the lightweight material, including, but not limited to, aluminum. The first beam 510, the second beam 512 and the torque transfer tube 506 are each formed using extrusion; however, other suitable forming techniques may be used. In this example, each of the first beam 510, the second beam 512 and the torque transfer tube 506 have the same cross-section. In one example, the cross-section is substantially I-shaped.

With reference to FIG. 4, the cross-section of the first beam 510 is shown, with the understanding that the cross-section of the second beam 512 and the torque transfer tube 506 is the same. As shown in FIG. 4, the cross-section of the first beam 510 defines a first chamber 522, a second chamber 524 and a third chamber 526. With reference to FIG. 5, the first chamber 522 and the second chamber 524 extend along a respective axis A5, A6, which is substantially parallel to a longitudinal axis L1 of the first beam 510. The third chamber 526 extends along an axis A7 that is substantially perpendicular to the longitudinal axis L1. In this example, with reference back to FIG. 4, a first end 526*a* of the third chamber 526 is defined by a first pair of oblique surfaces 528 that extend into the first chamber 522, and a second end 526*b* of the third chamber 526 is defined by a second pair of oblique surfaces 530 that extend into the second chamber 524. Generally, the first chamber 522 and the second chamber 524 extend outwardly on either side of the third chamber 526 and cooperate to define a pair of channels 531 on opposing sides of the cross-section. As will be discussed, the opposing channels 531 of the first beam 510 and the second beam 512 cooperate to receive a portion of the knee mounting subassembly 520.

Figure 6:
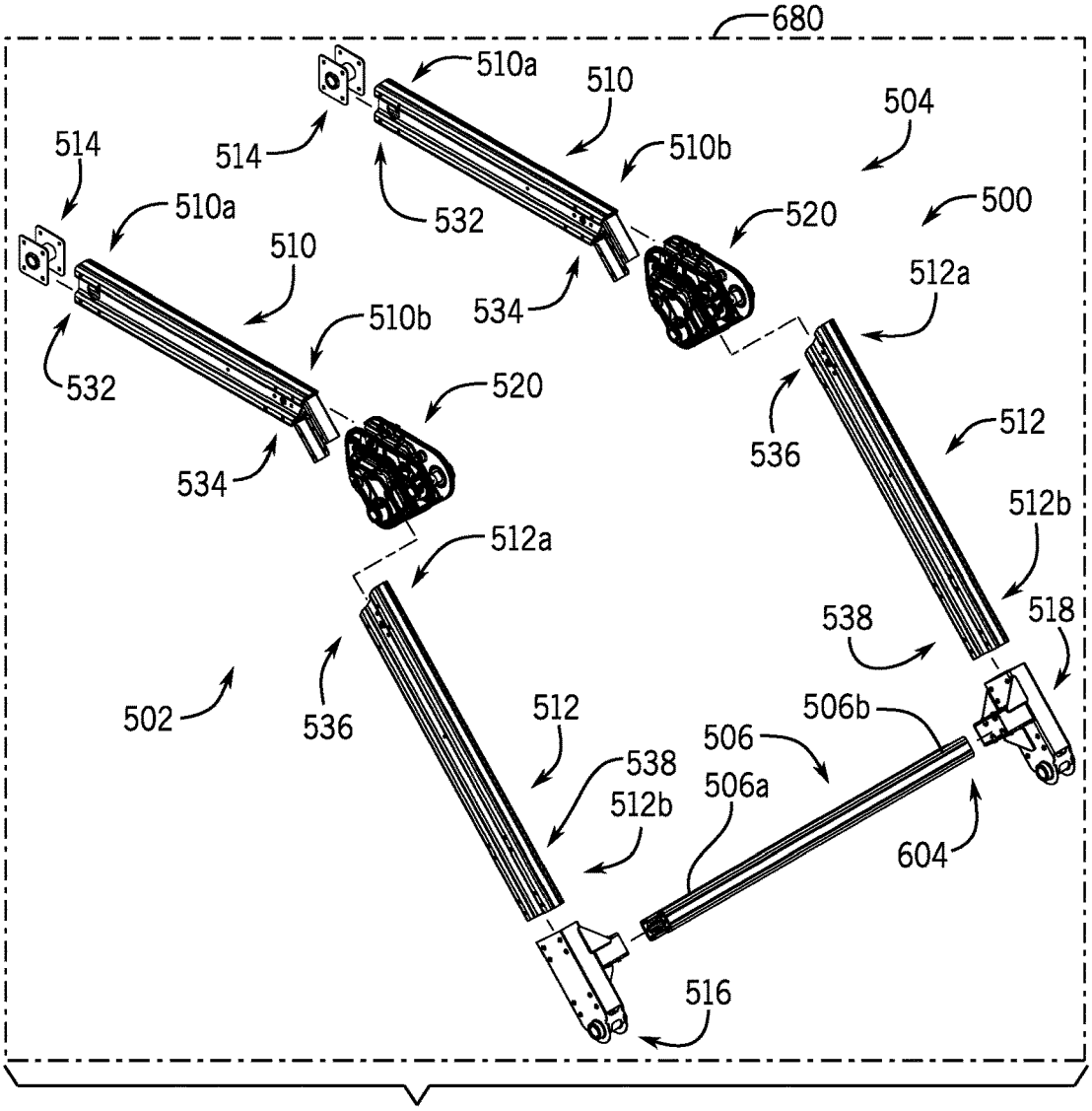
FIG. 6 is a partially exploded view of the hybrid loader boom arm assembly of FIG. 3.

With reference to FIG. 6, the first beam 510 includes a first end 510*a* and an opposite second end 510*b*. The first end 510*a* defines a respective first end of the arm assembly 502 and the second arm assembly 504. The first beam 510 defines a plurality of first through bores (generally identified by reference numeral 532) at the first end 510*a*, and defines a plurality of second through bores (generally identified by reference numeral 534) at the second end 510*b*. The first through bore 532 receives a portion of the vehicle mounting subassembly 514 to couple the vehicle mounting subassembly 514 to the first beam 510. The second through bores 534 are for coupling the first beam 510 to the knee mounting subassembly 520. It should be understood that each of the first through bore 532 and the second through bores 534 are defined in the first beam 510 so as to extend through the first beam 510. In one example, the second end 510*b* of the first beam 510 is beveled. By beveling the second end 510*b*, the second end 510*b* of the first beam 510 may be positioned against a cooperating bevel defined on a third end 512*a* of the second beam 512 so that the second beam 512 extends at an angle relative to the first beam 510.

The second beam 512 includes the third end 512*a* and an opposite fourth end 512*b*. The fourth end 512*b* defines a respective second end of the arm assembly 502 and the second arm assembly 504. In one example, the third end 512*a* of the second beam 512 is beveled. By beveling the third end 512*a*, the second beam 512 extends at an angle relative to the first beam 510 to assist in coupling the bucket 52 (FIG. 1) to the HLBAA 500. The second beam 512 defines a plurality of third through bores (generally identified by reference numeral 536) at the third end 512*a*, and defines a plurality of fourth through bores (generally identified by reference numeral 538) at the fourth end 512*b*. The third through bores 536 are for coupling the second beam 512 to the knee mounting subassembly 520. It should be understood that each of the third through bores 536 is defined in the second beam 512 so as to extend through the second beam 512. The fourth through bores 538 each receive a portion of the respective bucket mount bracket subassembly 516, 518 and the torque transfer tube 506 to couple the bucket mount bracket subassembly 516, 518 and the torque transfer tube 506 to the respective second beam 512.

Figure 7:
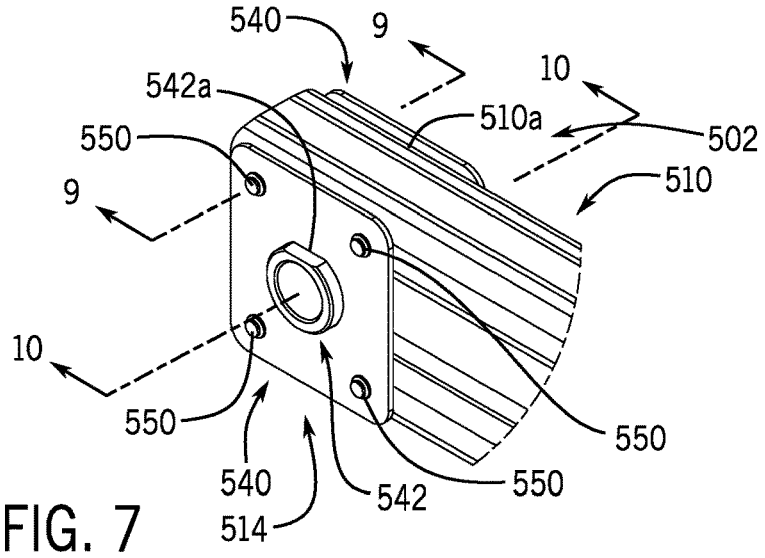
FIG. 7 is a detail view of a vehicle mounting subassembly of the hybrid loader boom arm assembly of FIG. 3.

The vehicle mounting subassembly 514 is coupled to the first end 510*a* of each first beam 510 of the arm assembly 502 and the second arm assembly 504. Stated another way, the vehicle mounting subassembly 514 is coupled to the first end of each of the arm assembly 502 and the second arm assembly 504, and is configured to couple the arm assembly 502 and the second arm assembly 504 to the loader 10. With reference to FIG. 7, the vehicle mounting subassembly 514 is shown in greater detail. As the vehicle mounting subassembly 514 is the same for both the arm assembly 502 and the second arm assembly 504, the vehicle mounting subassembly 514 will be shown in detail herein with regard to the first beam 510 of the arm assembly 502 for ease of description, with the understanding that the vehicle mounting subassembly 514 coupled to the second arm assembly 504 is the same.

Figure 8:
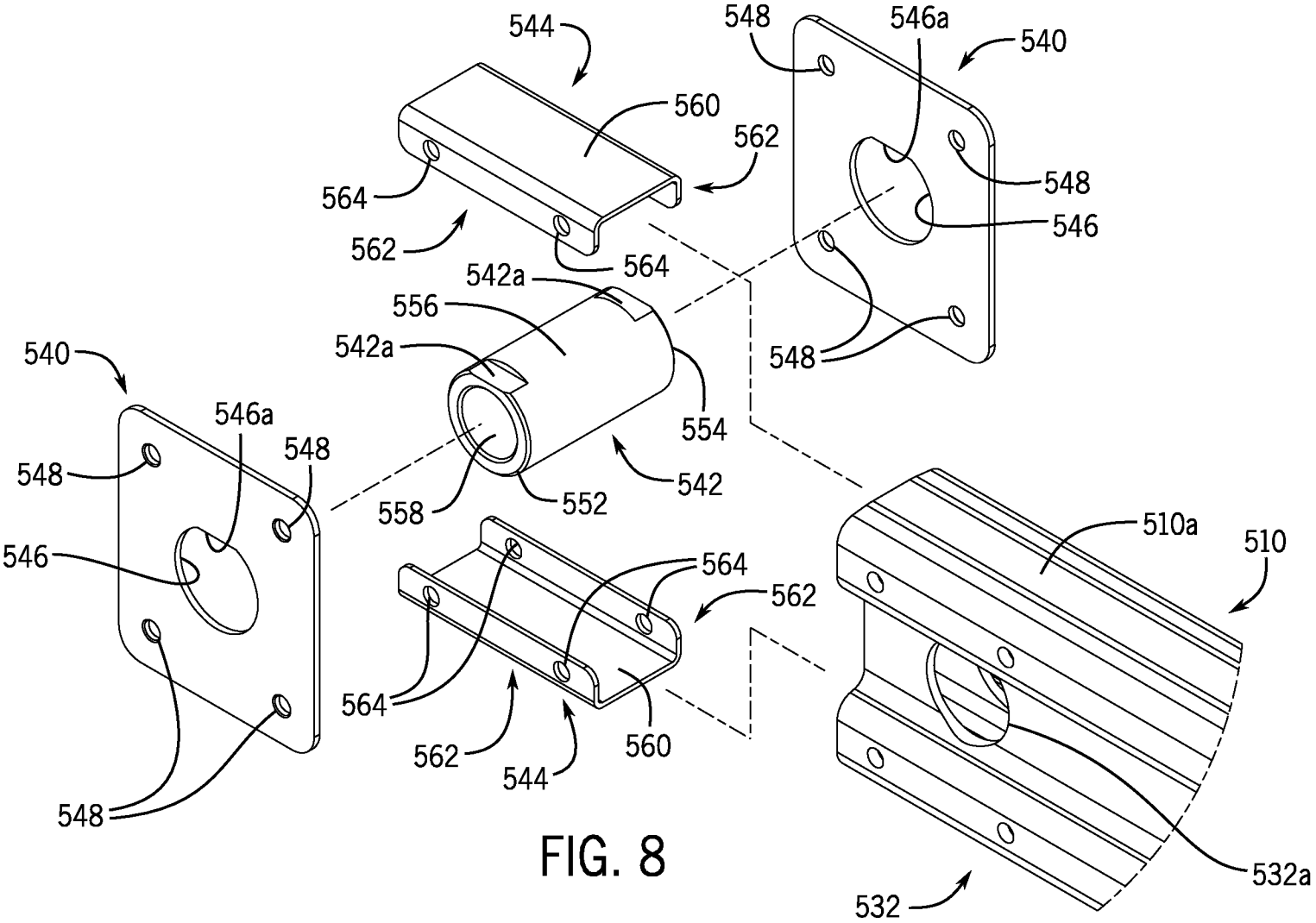
FIG. 8 is an exploded view of the vehicle mounting subassembly of FIG. 7.

A portion of the vehicle mounting subassembly 514 passes through the first end 510*a* of the first beam 510 for coupling the respective one of the arm assembly 502 and the second arm assembly 504 to the loader 10. With reference to FIG. 8, in one example, the vehicle mounting subassembly 514 includes a pair of lock plates 540, a sleeve 542 and a pair of intermediate plates 544. Each of the pair of lock plates 540 is composed of a metal or metal alloy, including, but not limited to, steel, and is cast, forged, stamped, etc. Each of the pair of lock plates 540 is square or rectangular; however, each of the pair of lock plates 540 may have any desired shape. Each of the pair of lock plates 540 defines a central bore 546 and a plurality of coupling bores 548. In one example, the central bore 546 includes a flat or keyed area 546*a*. The keyed area 546*a* cooperates with a respective flat or keyed area 542*a* on the sleeve 542 to inhibit relative rotation between the sleeve 542 and the pair of lock plates 540. In one example, each coupling bore 548 of the plurality of coupling bores 548 is spaced apart about a perimeter of the respective one of the pair of lock plates 540 to receive a respective mechanical fastener 550 (FIG. 7) for coupling the respective lock plate 540 to the first beam 510. The pair of lock plates 540 are generally coupled to the first beam 510 so as to be on opposed surfaces of the first beam 510.

The sleeve 542 is received through a central through bore 532*a* of the first through bores 532. In this example, the sleeve 542 is a hollow cylinder, and includes a first end 552 opposite a second end 554 and a midsection 556 that extends between the first end 552 and the second end 554. The sleeve 542 is composed of a metal or metal alloy, including, but not limited to, steel, and is cast, forged, stamped, etc. The first end 552 and the second end 554 each include the keyed area 546*a*. The keyed area 546*a* cooperates with the keyed area 546*a* of a respective one of the pair of lock plates 540 to inhibit rotation of the sleeve 542. The sleeve 542 defines a sleeve bore 558 that extends from the first end 552 to the second end 554. The sleeve bore 558 enables the pin 252 (FIG. 2) to pass through the vehicle mounting subassembly 514 to couple the respective one of the arm assembly 502 and the second arm assembly 504 to the loader 10.

Each of the intermediate plates 544 is composed of a metal or metal alloy, including, but not limited to, steel, and is cast, forged, stamped, etc. Each of the pair of intermediate plates 544 is substantially an elongated U-shape; however, each of the pair of intermediate plates 544 may have any desired shape. Each of the pair of intermediate plates 544 is received wholly within the first beam 510 at the first end 510*a* to couple the pair of lock plates 540 to the first beam 510. Each of the pair of intermediate plates 544 includes a base 560 and a pair of flanges 562, which extend outwardly from the base 560 on opposed sides of the base 560. Each of the pair of flanges 562 defines a plurality of bores 564. In one example, each bore 564 is spaced apart along the respective one of the pair of flanges 562 to receive a respective one of the mechanical fasteners 550 for coupling the respective lock plate 540 to the first beam 510.

Figure 9:
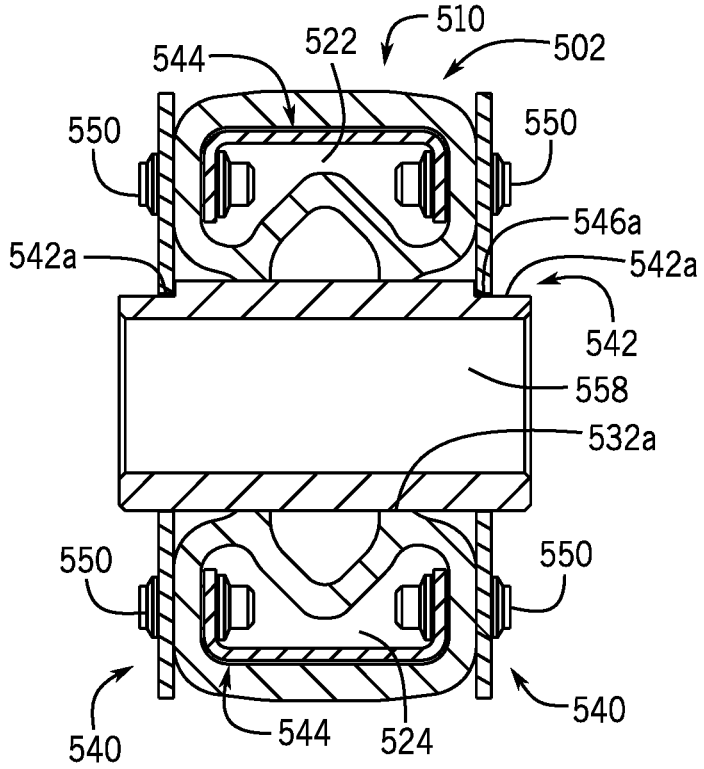
FIG. 9 is a cross-sectional view of the vehicle mounting subassembly, taken along line 9-9 of FIG. 7.
Figure 10:
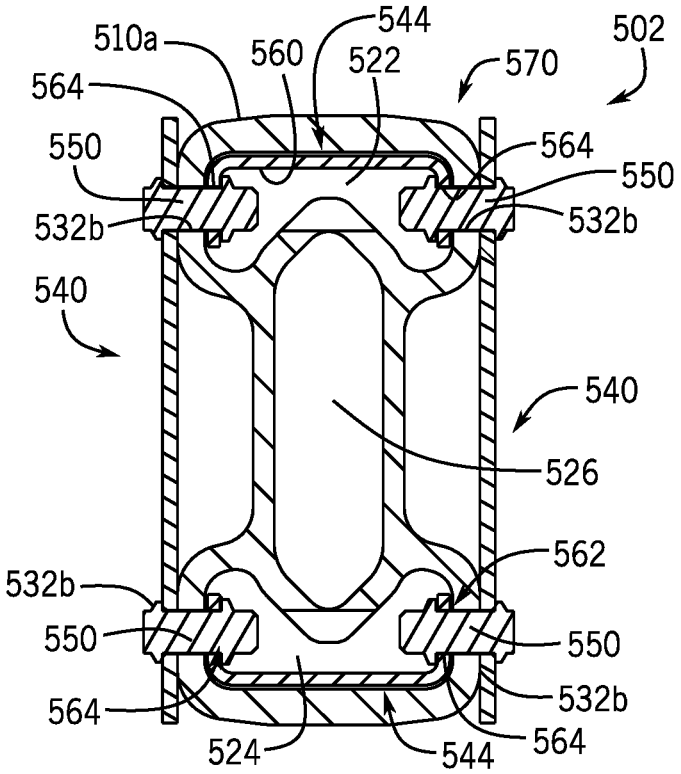
FIG. 10 is a cross-sectional view of the vehicle mounting subassembly, taken along line 10-10 of FIG. 7.

In this regard, with reference to FIG. 9, generally, one of the intermediate plates 544 is disposed within the first chamber 522 and the other one of the intermediate plates 544 is disposed within the second chamber 524. The sleeve 542 is inserted the through bore 532*a*. With the intermediate plates 544 disposed within the first end 510*a*, the bores 564 are coaxially aligned with remaining through bores 532*b* of the first plurality of through bores 532 defined through the first end 510*a*. With additional reference to FIG. 10, the mechanical fasteners 550 are inserted into each of the through bores 532*b* and the bores 564 to couple the lock plates 540 and the intermediate plates 544 to the first end 510*a* of the first beam 510. In this example, the mechanical fasteners 550 are blind oversized mechanical (BOM) fasteners, and one of the mechanical fasteners 550 is associated with each of the bores 564 and the through bores 532*b*. It should be noted that the use of BOM fasteners is merely exemplary, as rivets, bolts, etc. may be used to couple the lock plates 540 to the intermediate plates 544, and thus, to the first beam 510, if desired. Further, it should be noted that the number of bores 564 and the corresponding through bores 532*b* is merely exemplary, as any number of bores 564 and through bores 532*b* may be defined for the receipt of the mechanical fasteners 550.

Figures 11, 12:
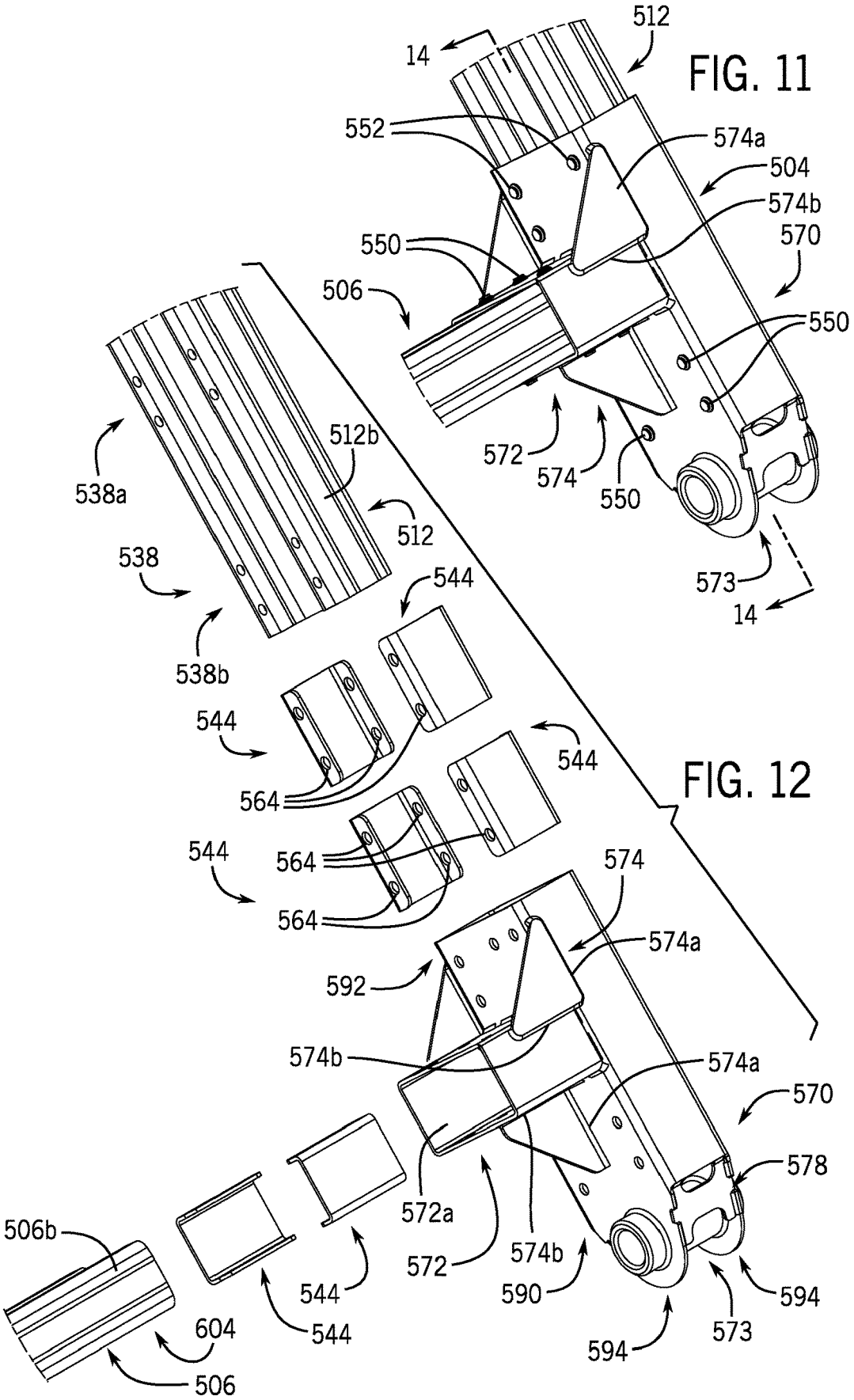
FIG. 11 is a detail view of a bucket mount bracket subassembly coupled to a second beam and a torque transfer tube of the hybrid loader boom arm assembly of FIG. 3.
FIG. 12 is an exploded view of the bucket mount bracket subassembly, the second beam and the torque transfer tube of the hybrid loader boom arm assembly of FIG. 11
Figure 13:
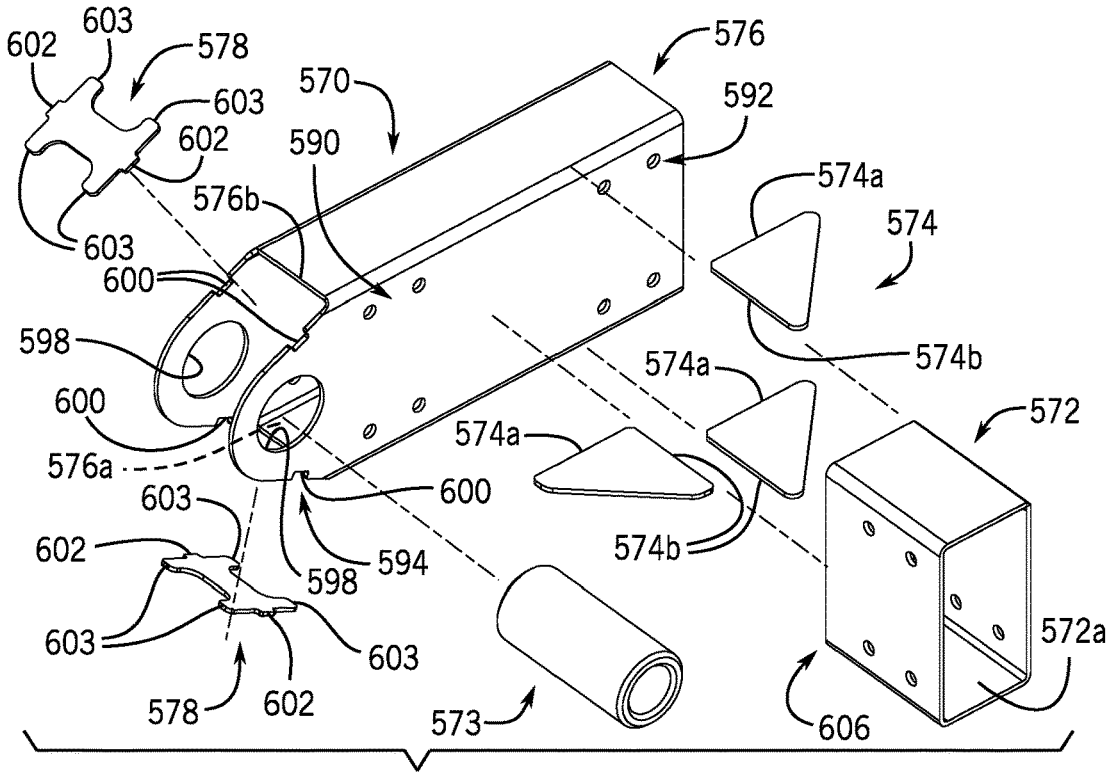
FIG. 13 is an exploded view of the bucket mount bracket subassembly of FIG. 12.

With reference back to FIG. 6, the bucket mount bracket subassembly 516, 518 couples the bucket 52 (FIG. 1 or FIG. 1A) to the HLBAA 500. With reference to FIGS. 11-13, the bucket mount bracket subassembly 518 is shown in greater detail. As the bucket mount bracket subassembly 518 is a mirror image of the bucket mount bracket subassembly 516, for ease of description, the bucket mount bracket subassembly 518 will be discussed herein with the understanding that the bucket mount bracket subassembly 516 is substantially the same. The bucket mount bracket subassembly 518 includes a first outer jacket assembly 570, a second outer jacket 572, a plurality of supports 574, a bushing 573, a plurality of pairs of the intermediate plates 544 (FIG. 12) and a plurality of the mechanical fasteners 550.

The first outer jacket assembly 570 is sized and configured to enclose the fourth end 512*b* of the second beam 512. In one example, with reference to FIG. 13, the first outer jacket assembly 570 includes a jacket 576 and a pair of reinforcing flanges 578. The jacket 576 and the reinforcing flanges 578 are each composed of a metal or metal alloy, including, but not limited to, steel, and is cast, forged, stamped, etc. The jacket 576 is tubular in shape, and defines a channel 576*a,* which receives the third end 512*a* of the second beam 512. The jacket 576 also defines a first plurality of bores 590, a second plurality of bores 592 and a pair of retaining flanges 594. The first plurality of bores 590 receives a respective one of the mechanical fasteners 550 to couple the jacket 576 to the second beam 512 via one pair of the intermediate plates 544 (FIG. 12). The second plurality of bores 592 receives a respective one of the mechanical fasteners 550 to couple the jacket 576 to the second beam 512 via one pair of the intermediate plates 544 (FIG. 12). With reference to FIG. 13, the pair of retaining flanges 594 extends outwardly from an end 576*b* of the jacket 576. The pair of retaining flanges 594 are spaced apart at the end 576*b,* and each define a bore 598 and a pair of opposed notches 600. The bore 598 is sized and configured to receive the bushing 573 therethrough. The bushing 573 may be coupled to each of the retaining flanges 594 via welding, for example. The notches 600 are defined in the retaining flanges 594 so as to be on opposed sides of the bore 598. The notches 600 receive a portion of the reinforcing flanges 578 to couple the reinforcing flanges 578 to the jacket 576.

The pair of reinforcing flanges 578 provides additional rigidity to the retaining flanges 594. In one example, the reinforcing flanges 578 are substantially H-shaped, and include a plurality of tabs 602 and a plurality of legs 603. Each tab 602 is coupled to a respective one of the notches 600 associated with the retaining flanges 594, and each leg 603 is coupled along an edge of the respective retaining flange 594. In one example, the reinforcing flanges 578 are each composed of a metal or metal alloy, including, but not limited to, steel, and is cast, forged, stamped, etc. In this example, the reinforcing flanges 578 are coupled to the retaining flanges 594 via welding.

With reference to FIG. 12, the second outer jacket 572 is sized and configured to enclose a second tube end 506*b* of the torque transfer tube 506. In one example, the second outer jacket 572 is composed of a metal or metal alloy, including, but not limited to, steel, and is cast, forged, stamped, etc. The second outer jacket 572 is tubular in shape, and defines a channel 572*a,* which receives the second tube end 506*b* of the torque transfer tube 506. With reference to FIG. 13, the second outer jacket 572 also defines a plurality of bores 606. The plurality of bores 606 receives a respective one of the mechanical fasteners 550 to couple the second outer jacket 572 to the torque transfer tube 506 via one pair of the intermediate plates 544 (FIG. 12). In one example, the second outer jacket 572 is coupled to the jacket 576 via welding.

The plurality of supports 574 imparts stiffness to the connection of the jacket 576 and the second outer jacket 572. In this example, the supports 574 are each triangular in shape, however, the supports 574 may have any desired shape. Each of the supports 574 is composed of a metal or metal alloy, including, but not limited to, steel, and is cast, forged, stamped, etc. The supports 574 are coupled to each of the jacket 576 and the second outer jacket 572 via welding, for example. Generally, a first surface 574*a* of each of the supports 574 is coupled to the jacket 576, and a second surface 574*b* of each of the supports 574 is coupled to the second outer jacket 572.

The bushing 573 comprises a hollow cylinder. The bushing 573 is composed of metal or metal alloy, including, but not limited to, steel, and is cast, forged, stamped, extruded, etc. The bushing 573 is coupled to the respective one of the pair of retaining flanges 594. Generally, the bushing 573 is received through the bores 598 and is coupled to the respective one of the pair of retaining flanges 594, via welding, for example. A midsection of the bushing 573 is positioned between the pair of retaining flanges 594, and is configured to receive a portion of a hook 52*a* (FIG. 2) of the bucket 52 to couple the bucket 52 to the second beam 512.

The plurality of pairs of the intermediate plates 544 (FIG. 12) and the plurality of the mechanical fasteners 550 interconnect the torque transfer tube 506 with the second outer jacket 572, and interconnect the first outer jacket assembly 570 with the second beam 512. In one example, with reference to FIG. 12, two of the intermediate plates 544 cooperate with a first sub-plurality 538*a* of the plurality of bores 538 of the second beam 512 and with the plurality of bores 592 to couple the first outer jacket assembly 570 to the second beam 512; and two of the intermediate plates 544 cooperate with a second sub-plurality 538*b* of the plurality of bores 538 of the second beam 512 and with the plurality of bores 592 to couple the first outer jacket assembly 570 to the second beam 512.

Figure 14:
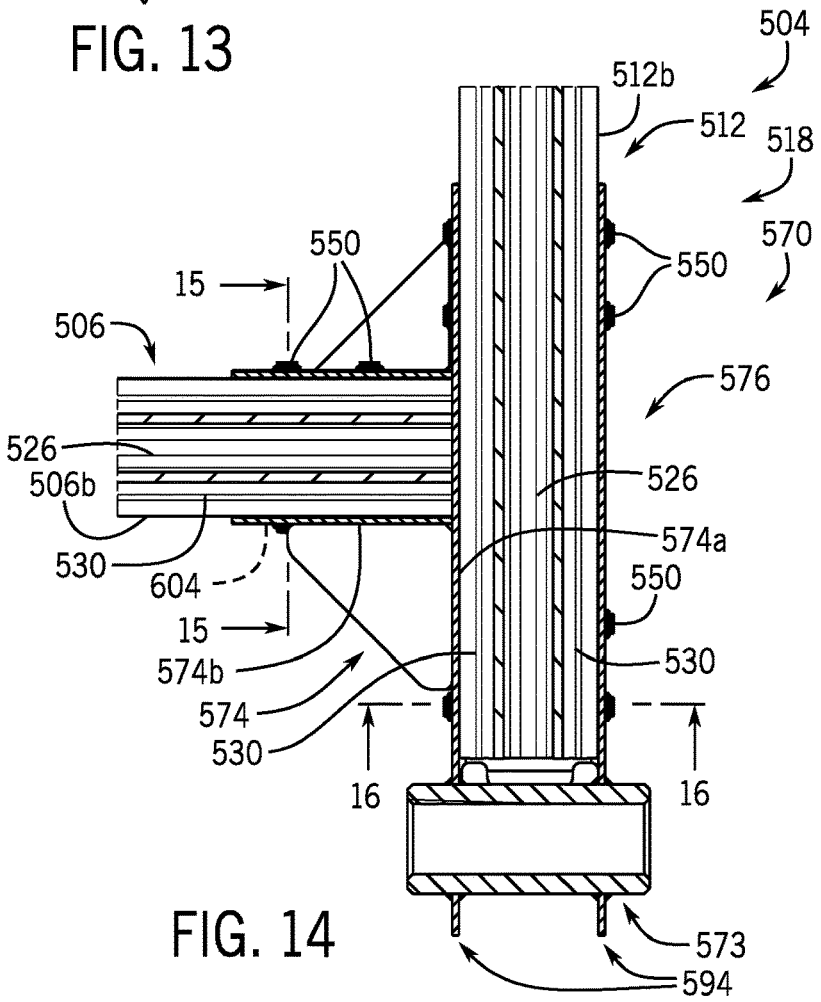
FIG. 14 is a cross-sectional view of the bucket mount bracket subassembly, taken along line 14-14 of FIG. 11.
Figure 16:
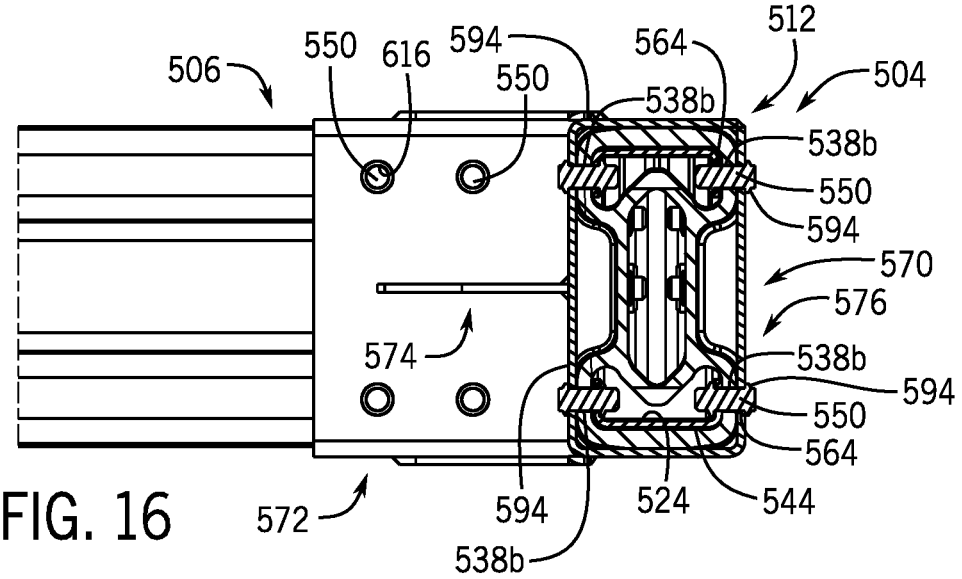
FIG. 16 is a cross-sectional view of the bucket mount bracket subassembly, taken along line 16-16 of FIG. 14.

In this example, two of the intermediate plates 544 are positioned in the first chamber 522 and the second chamber 524, respectively, such that the bores 564 of the intermediate plates 544 are coaxially aligned with the first sub-plurality 538*a* of the plurality of bores 538. With reference to FIG. 16, two of the intermediate plates 544 are also positioned in the first chamber 522 and the second chamber 524, respectively, and such that the bores 564 of the intermediate plates 544 are coaxially aligned with the second sub-plurality 538*b* of the plurality of bores 538. With the first outer jacket assembly 570 disposed over the fourth end 512*b,* the mechanical fasteners 550 are inserted through the plurality of bores 592, the first sub-plurality 538*a* of the plurality of bores 538 and into the bores 564 of the intermediate plates 544 to couple the first outer jacket assembly 570 to the second beam 512 (FIG. 14). The mechanical fasteners 550 are also inserted through the plurality of bores 590, the second sub-plurality 538*b* of the plurality of bores 538 and into the bores 564 of the intermediate plates 544 to couple the first outer jacket assembly 570 to the second beam 512 (FIG. 14).

Figure 15:
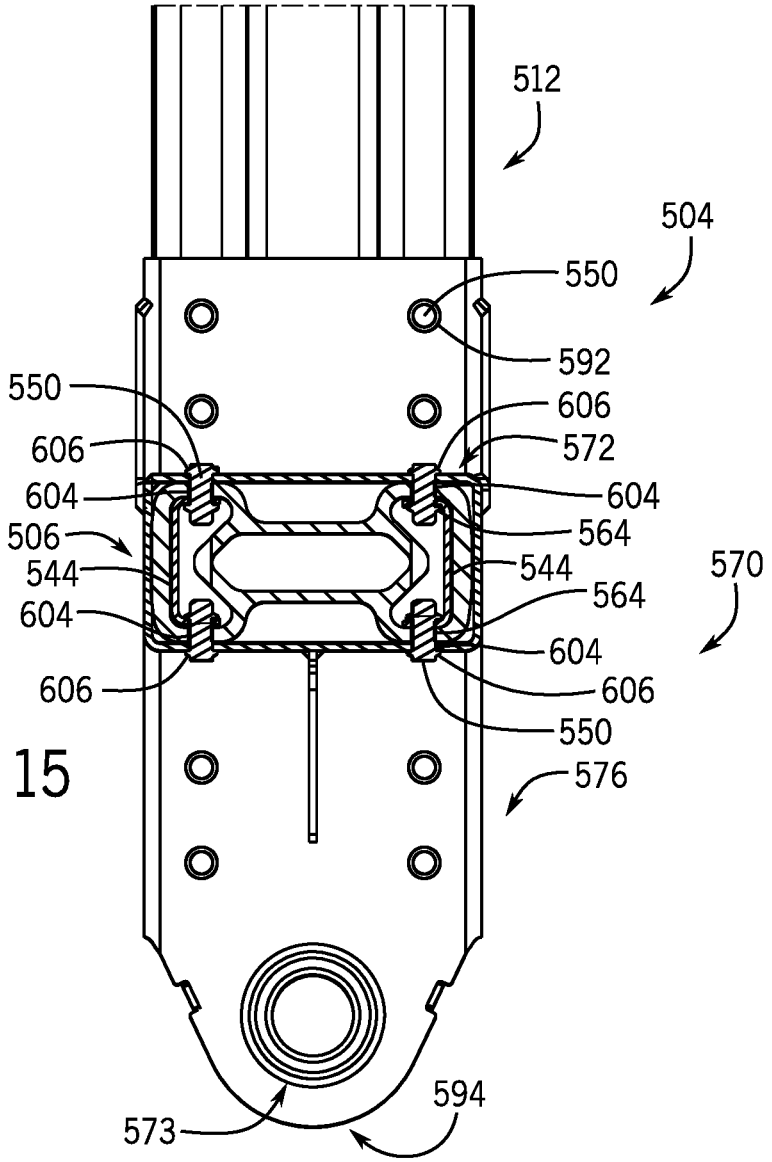
FIG. 15 is a cross-sectional view of the bucket mount bracket subassembly, taken along line 15-15 of FIG. 14.

In one example, with reference to FIG. 12, two of the intermediate plates 544 cooperate with a plurality of bores 604 of the torque transfer tube 506 and with the plurality of bores 606 to couple the second outer jacket 572 to the torque transfer tube 506. With reference to FIG. 15, two of the intermediate plates 544 are positioned in the first chamber 522 and the second chamber 524, respectively, of the torque transfer tube 506 such that the bores 564 of the intermediate plates 544 are coaxially aligned with the plurality of bores 604. With the second outer jacket 572 disposed over the second tube end 506*b,* the mechanical fasteners 550 are inserted through the plurality of bores 604, the plurality of bores 606 and into the bores 564 of the intermediate plates 544 to couple the second outer jacket 572 to the torque transfer tube 506 (FIG. 14).

Figure 17:
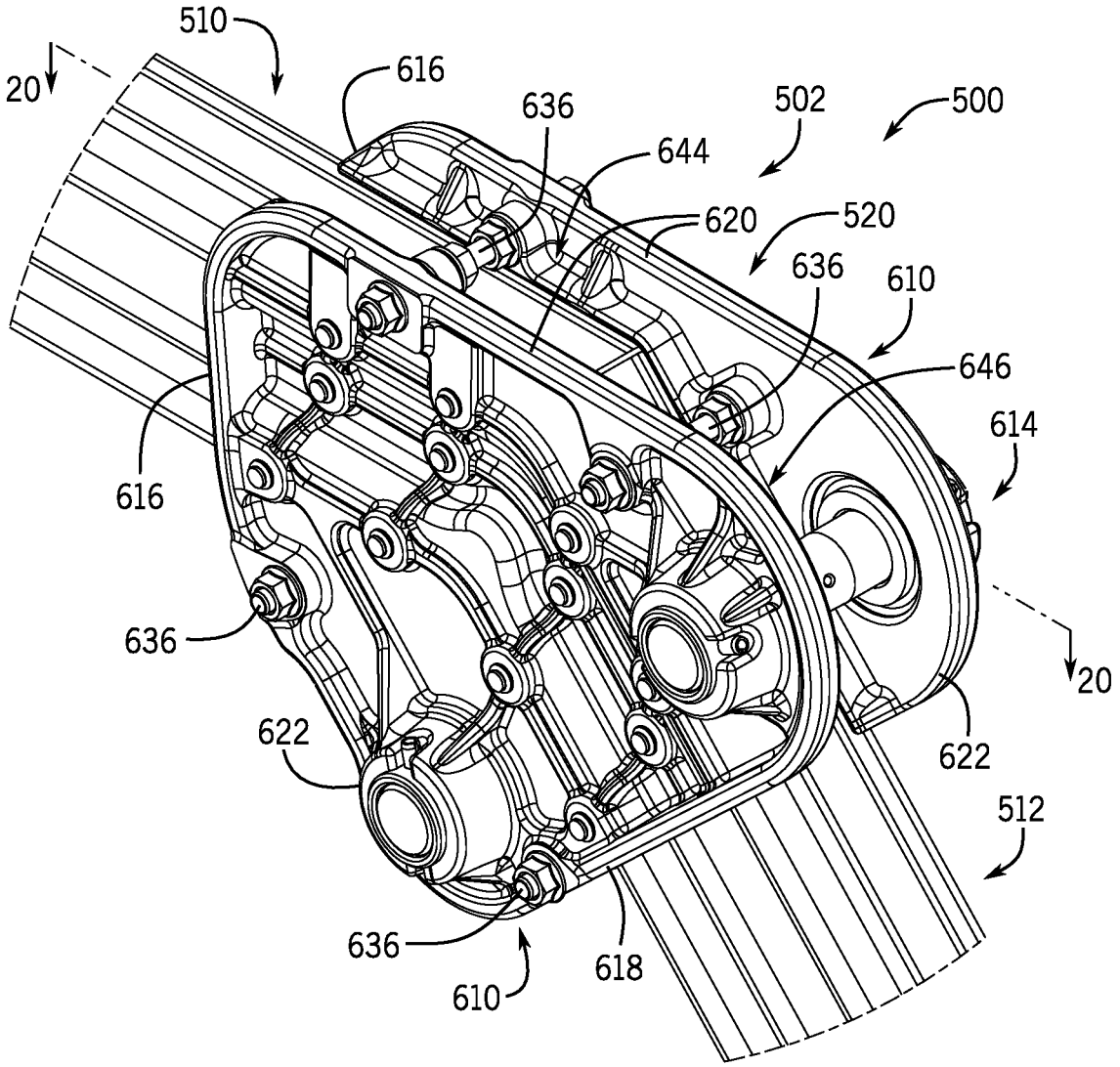
FIG. 17 is a detail view of a knee mounting subassembly of the hybrid loader boom arm assembly of FIG. 3.
Figure 18:
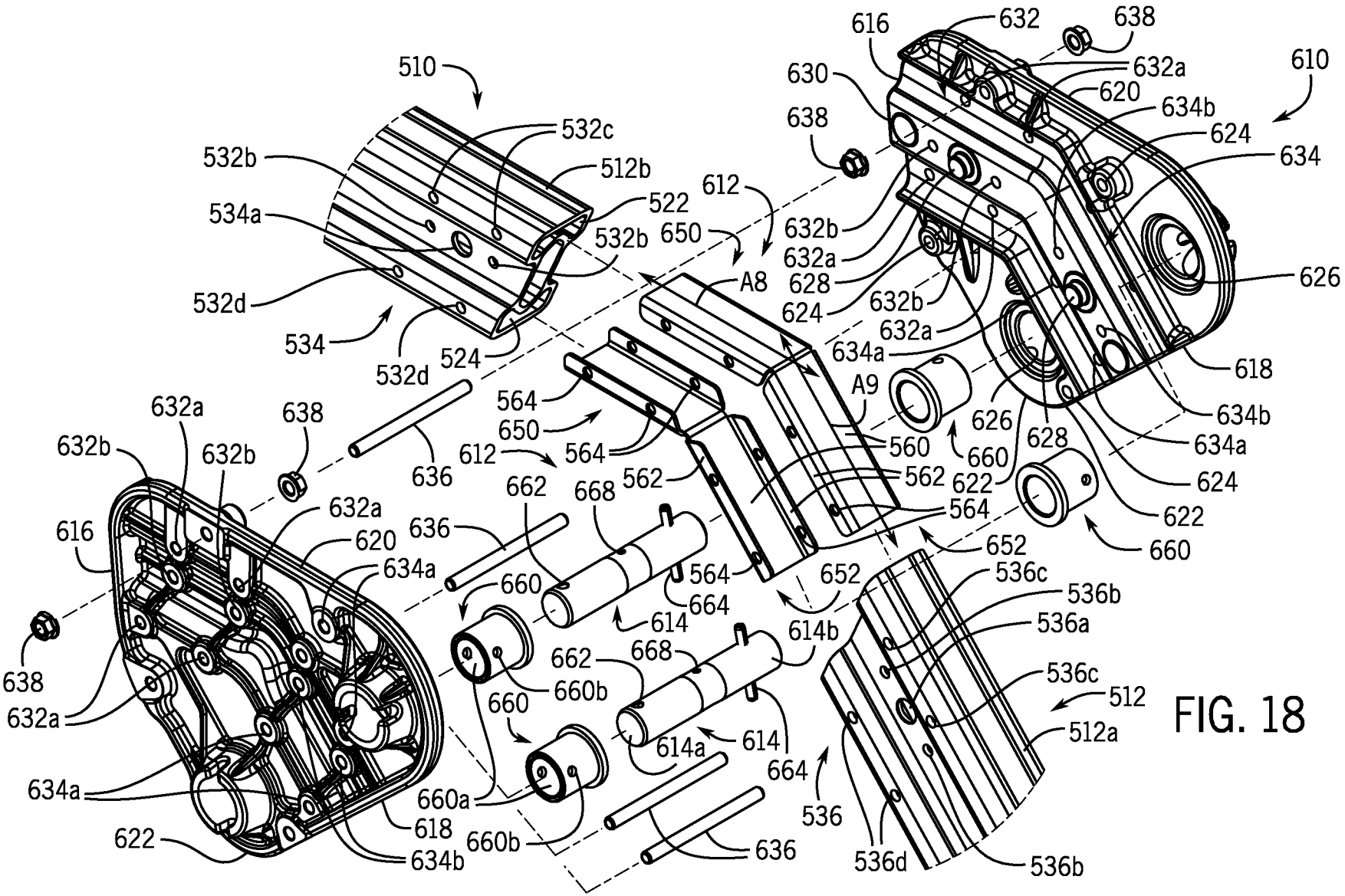
FIG. 18 is an exploded view of the knee mounting subassembly of FIG. 17.

With reference to FIGS. 17 and 18, the knee mounting subassembly 520 interconnects the first beam 510 with the second beam 512. The knee mounting subassembly 520 comprises a connection assembly for the first beam 510 and the second beam 512. The knee mounting subassembly 520 includes a pair of knee plates 610, a pair of angled intermediate plates 612 (FIG. 18) and a pair of coupling pins 614. Each of the knee plates 610 is composed of metal or metal alloy, including, but not limited to, aluminum, and in this example, is die-cast. Each of the pair of knee plates 610 includes a first plate end 616 opposite a second plate end 618, and a first plate side 620 opposite a second plate side 622. Each knee plate 610 includes a plurality of knee coupling bores 624, a pair of pin coupling bores 626, a pair of locating pins 628, a channel 630, a first plurality of bores 632 and a second plurality of bores 634.

Figure 18A:
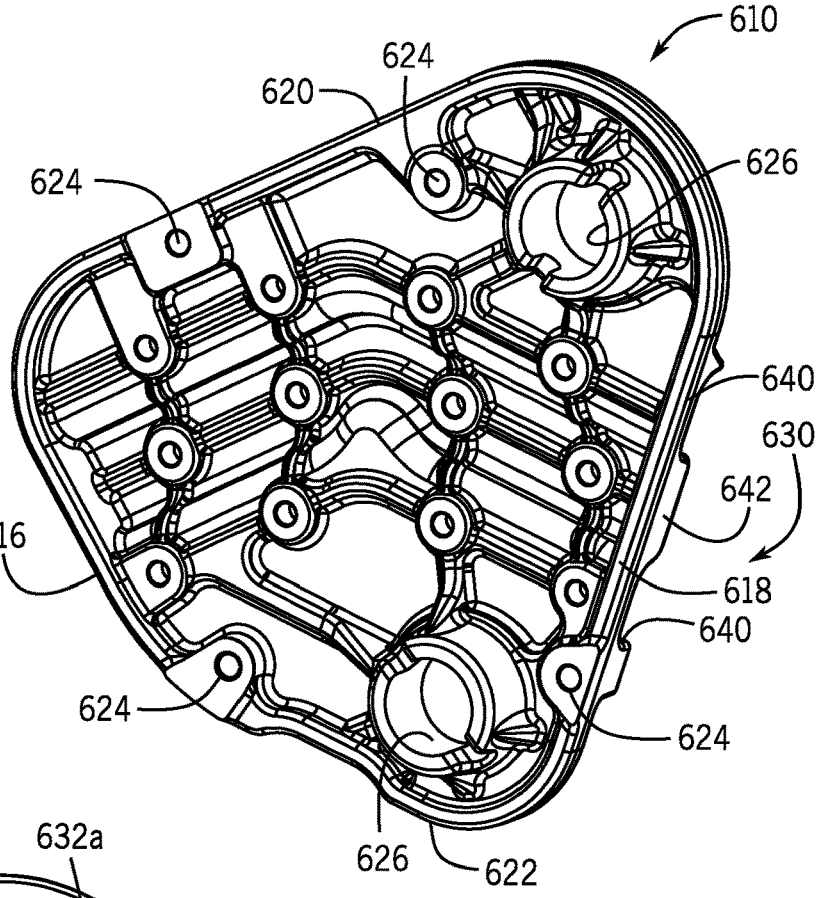
FIG. 18A is a side view of one of the knee plates of the knee mounting subassembly of FIG. 17.
Figure 18B:
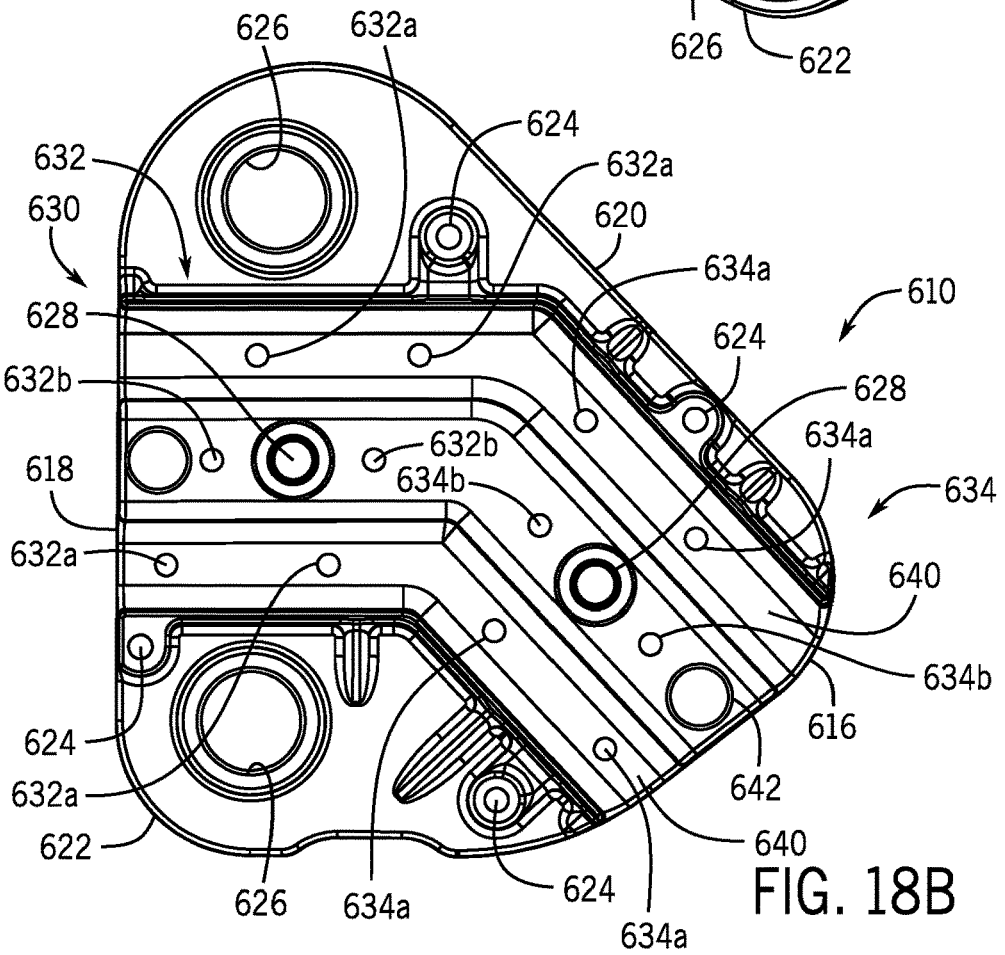
FIG. 18B is an opposing side view of one of the knee plates of the knee mounting subassembly of FIG. 17.

The plurality of knee coupling bores 624 receives a respective knee mechanical fastener 636, such as a knee bolt, to couple the knee plates 610 together. In one example, the knee plates 610 define four knee coupling bores 624 that receive a respective one of four knee mechanical fasteners 636 (FIGS. 18A and 18B). The knee coupling bores 624 of each of the knee plates 610 are coaxially aligned for receiving the respective knee mechanical fastener 636. In one example, each of the knee mechanical fasteners 636 has a plurality of threads defined at opposed ends, which matingly engage with respective pairs of flange nuts 638, for example, to secure each of the knee mechanical fasteners 636 to the knee plates 610. In this example, one of the knee coupling bores 624 is defined at the first side 620 adjacent to the first plate end 616, and one of the knee coupling bores 624 is defined at the first side 620 between the one of the knee coupling bores 624 and the second plate end 618. Another one of the knee coupling bores 624 is defined at the second side 622 adjacent to the first plate end 616, and a final one of the knee coupling bores 624 is defined at the second side 622 at the second plate end 618 (FIGS. 18A and 18B).

The pair of pin coupling bores 626 receives a respective one of the coupling pins 614. One of the pin coupling bores 626 is defined at the first side 620 at the second plate end 618, and the other of the pin coupling bores 626 is defined at the second side 622 at the second plate end 618. The pair of locating pins 628 is integrally formed or monolithic with the knee plates 610. The locating pins 628 are formed to extend outwardly from the channel 630. One of the locating pins 628 engages a bore 534*a* of the plurality of bores 534 of the first beam 510, and the other of the locating pins 628 engages a bore 536*a* of the plurality of bores 536 of the second beam 512. The locating pins 628 facilitate the coupling of the knee plates 610 to the first beam 510 and the second beam 512.

Figure 19:
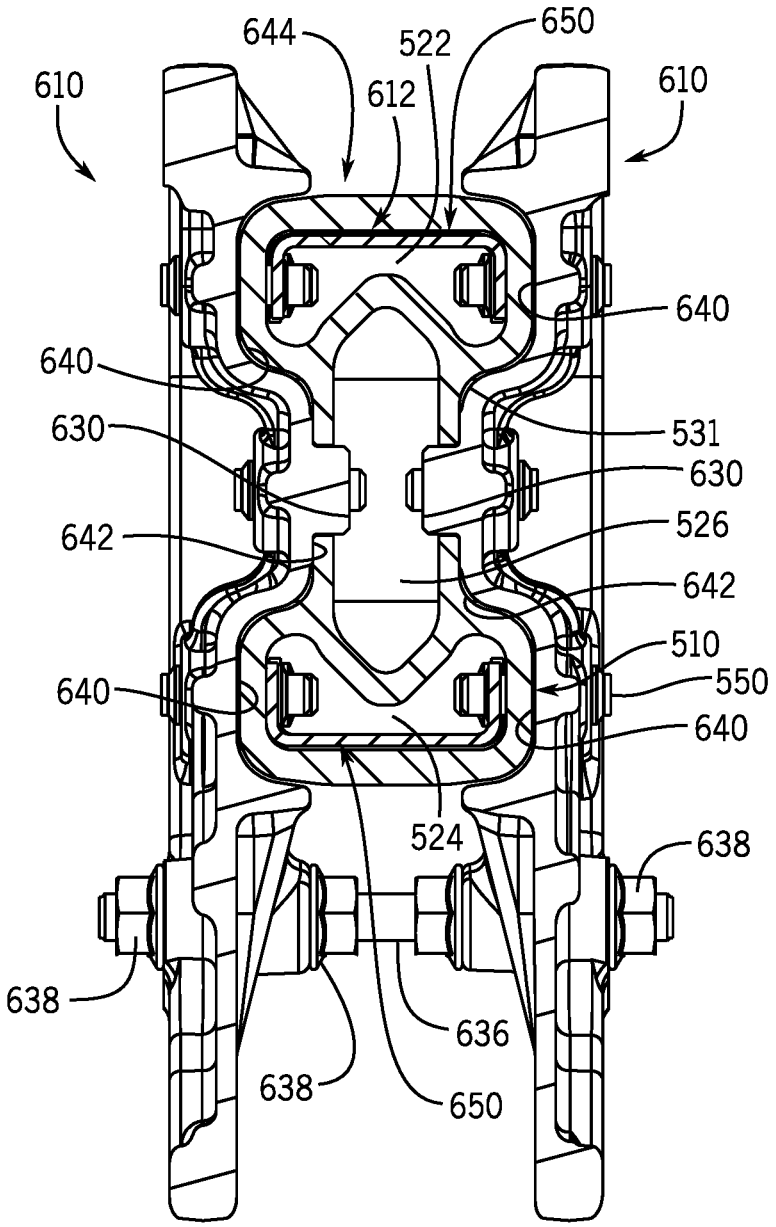
FIG. 19 is a cross-sectional view of the knee mounting subassembly of FIG. 17, taken along line 19-19 of FIG. 20.

The channel 630 is defined along each of the knee plates 610 from the first plate end 616 to the second plate end 618. The channel 630 includes two grooves 640 that are separated by a rail 642. The two grooves 640 and the rail 642 of the knee plates 610 cooperate to define a first channel portion 644 (FIG. 19) that receives the first beam 510 and a second channel portion 646 that receives the second beam 512 (FIG. 17). Stated another way, the two grooves 640 and the rail 642 of the knee plates 610 cooperate to define a cross-section that corresponds to the cross-section of each of the first beam 510 and the second beam 512 (FIGS. 18A and 18B). Generally, each of the grooves 640 of the knee plates 610 cooperate to surround the portion of the first beam 510 and the second beam 512 defined by the first chamber 522 and the second chamber 524, respectively, and the rails 642 of each of the knee plates 610 are received along either side of the channels 531 defined by the shape of the third chamber 526 of the first beam 510 and the second beam 512.

The first plurality of bores 632 couple the knee plates 610 to the first beam 510. A first sub-plurality 632*a* of the first plurality of bores 632 receive respective ones of the mechanical fasteners 550 to couple the knee plates 610 to the first beam 510 via the angled intermediate plates 612. A second sub-plurality 632*b* of the first plurality of bores 632 receive respective ones of the mechanical fasteners 550 to couple the knee plate 610 to the first beam 510 via a sub-plurality 532*b* of the second plurality of bores 532 of the first beam 510 (FIGS. 18A and 18B).

The second plurality of bores 634 couple the knee plates 610 to the second beam 512. A first sub-plurality 634*a* of the second plurality of bores 634 receive respective ones of the mechanical fasteners 550 to couple the knee plates 610 to the second beam 512 via the angled intermediate plates 612. A second sub-plurality 634*b* of the second plurality of bores 634 receive respective ones of the mechanical fasteners 550 to couple the knee plate 610 to the second beam 512 via a sub-plurality 534*b* of the second plurality of bores 534 of the second beam 512 (FIGS. 18A and 18B).

The pair of angled intermediate plates 612 interconnect the knee plates 610 with the first beam 510 and the second beam 512; and interconnect the first beam 510 with the second beam 512. Each of the angled intermediate plates 612 is composed of a metal or metal alloy, including, but not limited to, steel, and is cast, forged, stamped, etc. Each of the pair of angled intermediate plates 612 is substantially an elongated U-shape; however, each of the pair of angled intermediate plates 612 may have any desired shape. Each of the pair of angled intermediate plates 612 is received wholly within the first beam 510 at the second end 510*b* and the second beam 512 at the third end 512*a*. In one example, each of the angled intermediate plates 612 includes a first plate portion 650 interconnected to a second plate portion 652. In this example, the first plate portion 650 is integrally formed with the second plate portion 652; however, the first plate portion 650 may be separate from the second plate portion 652 and coupled together via welding, for example. The second plate portion 652 is angled relative to the first plate portion 650. Stated another way, the first plate portion 650 extends along an axis A8, and the second plate portion 652 extends along a second axis A9, and the second axis A9 is oblique to the axis A8.

Each of the first plate portion 650 and the second plate portion 652 includes the base 560 and the pair of flanges 562, which extend outwardly from the base 560 on opposed sides of the base 560. Each of the pair of flanges 562 defines the plurality of bores 564. Generally, the first plate portion 650 of one of the angled intermediate plates 612 is disposed within the first chamber 522 of the first beam 510 such that the bores 564 are coaxially aligned with a sub-plurality 532*c* of the plurality of bores 532, and the second plate portion 652 is disposed within the first chamber 522 of the second beam 512 such that the bores 564 are coaxially aligned with a sub-plurality 536*c* of the plurality of bores 536. The first plate portion 650 of the other of the angled intermediate plates 612 is disposed within the second chamber 524 of the first beam 510 such that the bores 564 are coaxially aligned with a sub-plurality 532*d* of the plurality of bores 532, and the second plate portion 652 is disposed within the second chamber 524 of the second beam 512 such that the bores 564 are coaxially aligned with a sub-plurality 536*d* of the plurality of bores 536.

Figure 20:
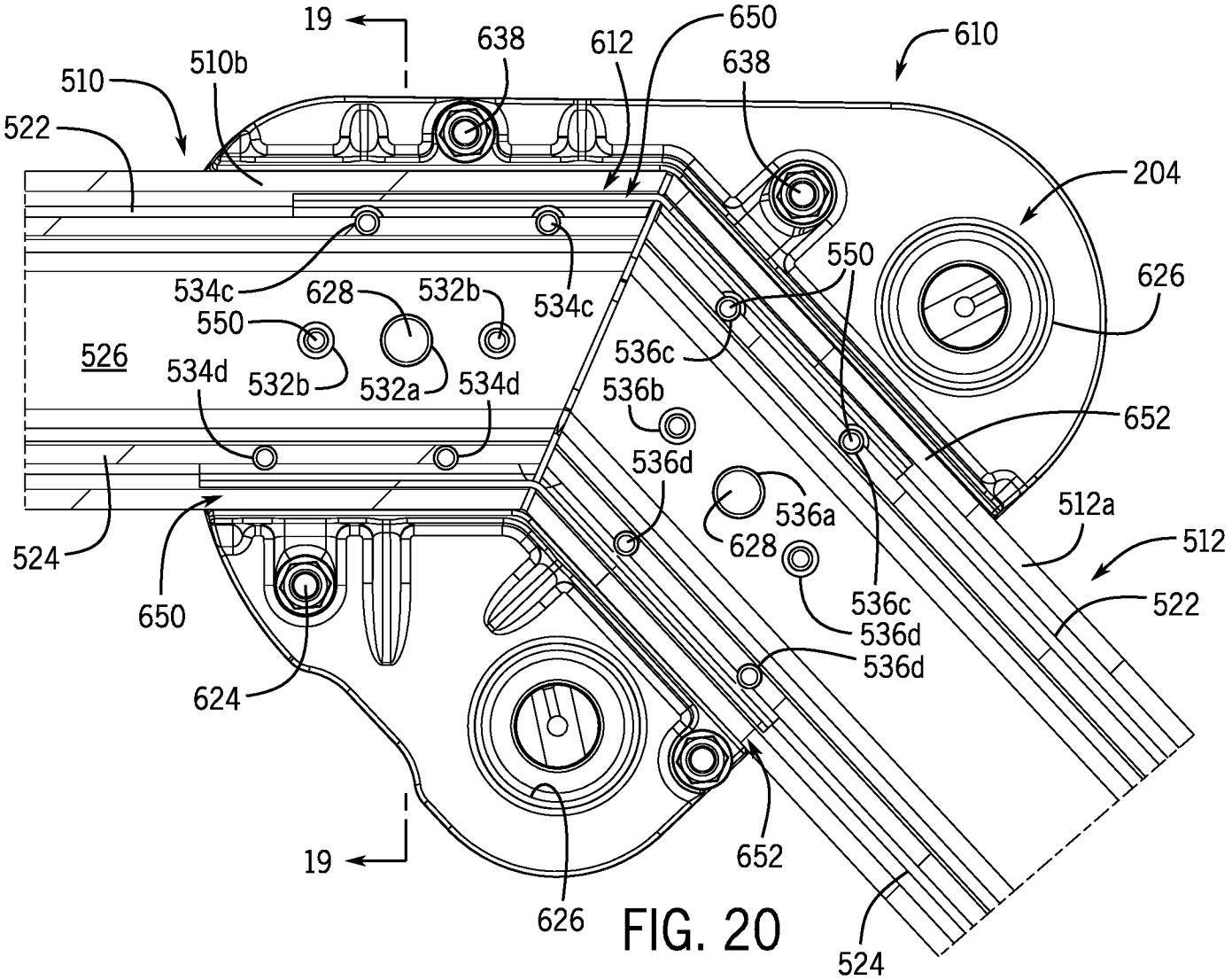
FIG. 20 is a cross-sectional view of the knee mounting subassembly of FIG. 17, taken along line 20-20 of FIG. 17.

With additional reference to FIG. 20, the mechanical fasteners 550 are inserted into each of the through bores 534*c*, the bores 564 and the bores 632*a* of the knee plates 610 to couple the knee plates 610 and the first plate portion 650 of one of the angled intermediate plates 612 to the first end 510*a* of the first beam 510. The mechanical fasteners 550 are also inserted into each of the through bores 534*d*, the bores 564 and the bores 632*a* of the knee plates 610 to couple the knee plates 610 and the first plate portion 650 of the other of the angled intermediate plates 612 to the first end 510*a* of the first beam 510. The mechanical fasteners 550 are inserted into each of the through bores 536*c*, the bores 564 and the bores 634*a* of the knee plates 610 to couple the knee plates 610 and the second plate portion 652 of one of the angled intermediate plates 612 to the third end 512*a* of the second beam 512. The mechanical fasteners 550 are also inserted into each of the through bores 536*d*, the bores 564 and the bores 634*a* of the knee plates 610 to couple the knee plates 610 and the second plate portion 652 of the other of the angled intermediate plates 612 to the third end 512*a* of the second beam 512. The mechanical fasteners 550 are inserted into the bores 632*a* of the knee plates 610 and the bores 532*b* of the first beam 510 to further couple the first beam 510 to the knee plates 610. The mechanical fasteners 550 are inserted into the bores 634*a* of the knee plates 610 and the bores 534*b* of the second beam 512 to further couple the second beam 512 to the knee plates 610.

The pair of coupling pins 614 couple the hydraulic cylinders 34, 36, 38 to the respective one of the arm assembly 502 and the second arm assembly 504. Each of the coupling pins 614 includes a pair of collars 660. The pair of collars 660 secures and retains the coupling pins 614 to the pair of knee plates 610. Generally, one of the coupling pins 614 is received through one pair of the pin coupling bores 626 and the other one of the coupling pins 614 is received through one pair of the pin coupling bores 626. A first one of the collars 660 is coupled to one end of one of the coupling pins 614, and a second one of the pair of collars 660 is coupled to the other opposed end of the respective one of the coupling pins 614. One of the pair of collars 660 is coupled to one end of the other one of the coupling pins 614, and the second one of the pair of collars 660 is coupled to the opposed end of the other coupling pins 614. Thus, each of the collars 660 includes a central collar bore 660*a* that receives the respective end of the coupling pin 614 therein (FIG. 17). In one example, one end 614*a* of the coupling pins 614 includes a through bore 662 that cooperates with corresponding cross-bores 660*b* defined in each of the collars 660. A pin is received within the cross-bores 660*b* and the cross-bores 660*b* to couple the end 614*a* of the coupling pins 614 to the knee plates 610. An opposed end 614*b* of the coupling pins 614 includes a cross-pin 664 that cooperates with corresponding cross-bores 660*b* defined in the collars 660. The cross-pin 664 is received within the cross-bores 660*b* to couple the end 614*b* of the coupling pins 614 to the knee plates 610. Each of the coupling pins 614 may also include a bore 668, which receives a pin, to couple the respective hydraulic cylinders 34, 36, 38 to the respective one of the arm assembly 502 and the second arm assembly 504.

Figure 21:
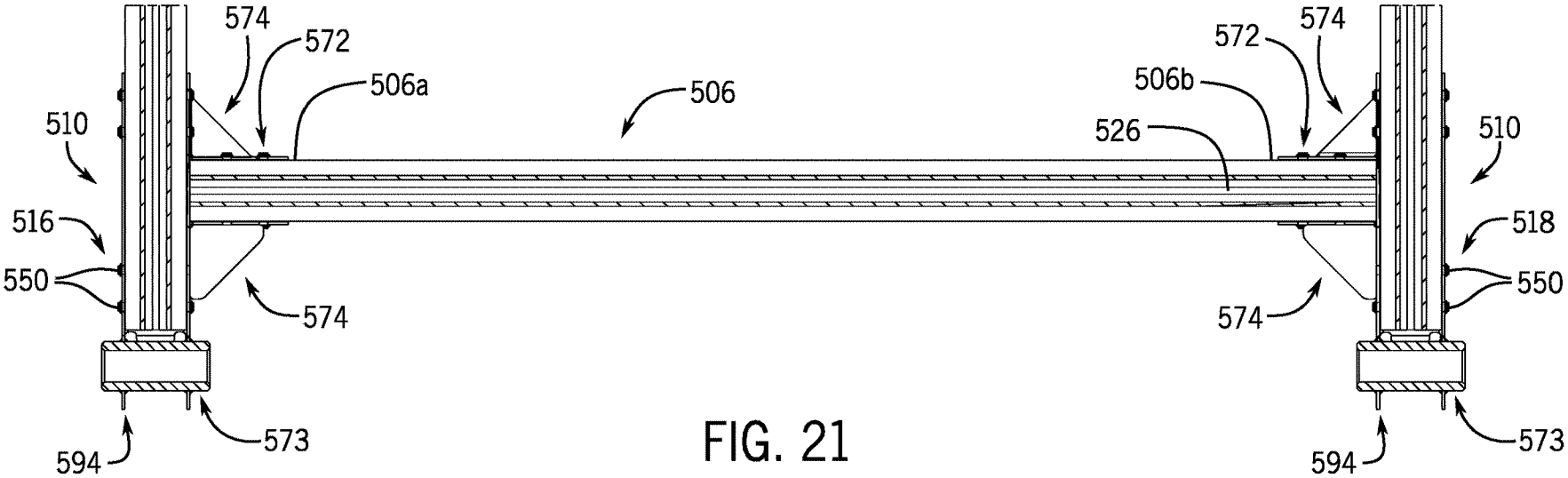
FIG. 21 is a cross-sectional view of a torque transfer tube connected to an arm assembly and a second arm assembly of the hybrid loader boom arm assembly, taken along line 21-21 of FIG. 3.

With reference back to FIG. 6, the torque transfer tube 506 interconnects the arm assembly 502 and the second arm assembly 504. The torque transfer tube 506 is coupled to each of the arm assembly 502 and the second arm assembly 504 at the fourth end 512*b* of the respective second beam 512. With reference to FIG. 21, the torque transfer tube 506 has a first tube end 506*a* and the opposite second tube end 506*b*. The first tube end 506*a* is coupled to the arm assembly 502, and the second tube end 506*b* is coupled to the second arm assembly 504. In one example, as discussed with regard to FIGS. 11-16, the first tube end 506*a* is received within and coupled to the second outer jacket 572 of the bucket mounting bracket subassembly 516, and the second tube end 506*b* is received within and coupled to the second outer jacket 572 of the bucket mounting bracket subassembly 518 via the intermediate plates 544 (FIG. 12) and the mechanical fasteners 550.

With reference back to FIG. 6, the first beams 510, the second beams 512, the vehicle mounting subassemblies 514, the bucket mount bracket subassemblies 516, 518, the knee mounting subassemblies 520, the torque transfer tube 506 and the mechanical fasteners 550 comprise a kit 680 for the HLBAA 500. In one example, in order to assemble the arm assembly 502 and the second arm assembly 504, with the first beams 510 and the second beams 512 formed, the first plate portion 650 of the angled intermediate plates 612 are inserted into the first chamber 522 and the second chamber 524 at the second end 510*b* of the first beams 510. The second plate portion 652 of the angled intermediate plates 612 are inserted into the first chamber 522 and the second chamber 524 at the third end 512*a* of the second beams 512. With reference to FIG. 18, the knee plates 610 are coupled to the second end 510*b* of the first beam 510 and the third end 512*a* of the second beam 512 such that the locating pins 628 are received within the bores 534*a*, 536*a*. The mechanical fasteners 550 are inserted into each of the through bores 534*c*, the bores 564 and the bores 632*a* of the knee plates 610 to couple the knee plates 610 and the angled intermediate plates 612 to the first end 510*a* of the first beam 510. The mechanical fasteners 550 are inserted into each of the through bores 536*c*, the bores 564 and the bores 634*a* of the knee plates 610 to couple the knee plates 610 and the angled intermediate plates 612 to the third end 512*a* of the second beam 512. The mechanical fasteners 550 are inserted into the bores 632*a*, 634*a* of the knee plates 610 and the bores 532*b*, 534*b* of the first beam 510 and the second beam 512, respectively, to further couple the first beam 510 and the second beam 512 to the knee plates 610. The knee mechanical fasteners 636 are inserted through the respective knee coupling bores 624 and secured with a respective pair of the flange nuts 638 to couple the knee plates 610 together. Each of the coupling pins 614 are inserted into a respective one of the pin coupling bores 626, and the collars 660 are positioned about the ends 614*a*, 614*b* of the coupling pins 614. The cross-pin 664 retains the ends 614*b* within the respective collar 660, and a pin is received through the bore 662 and the cross-bore 660*b* to retain the ends 614*a* within the respective collar 660.

With reference to FIG. 7, in order to couple the vehicle mounting subassembly 514 to the first beam 510 of the arm assembly 502, two intermediate plates 544 are positioned within the first end 510*a* of the first beam 510. The sleeve 542 is inserted through the bore 532*a* of the first end 510*a* of the first beam 510. The lock plates 540 are positioned on opposed sides of the first beam 510 such that the keyed area 542*a* of the sleeve 542 contacts the keyed area 546*a* on the lock plates 540. The mechanical fasteners 550 are inserted into each of the through bores 532*b* and the bores 564 to couple the lock plates 540 and the intermediate plates 544 to the first end 510*a* of the first beam 510. This process is repeated to couple the vehicle mounting subassembly 514 to the first beam 510 of the second arm assembly 504 (FIG. 3).

Figure 22:
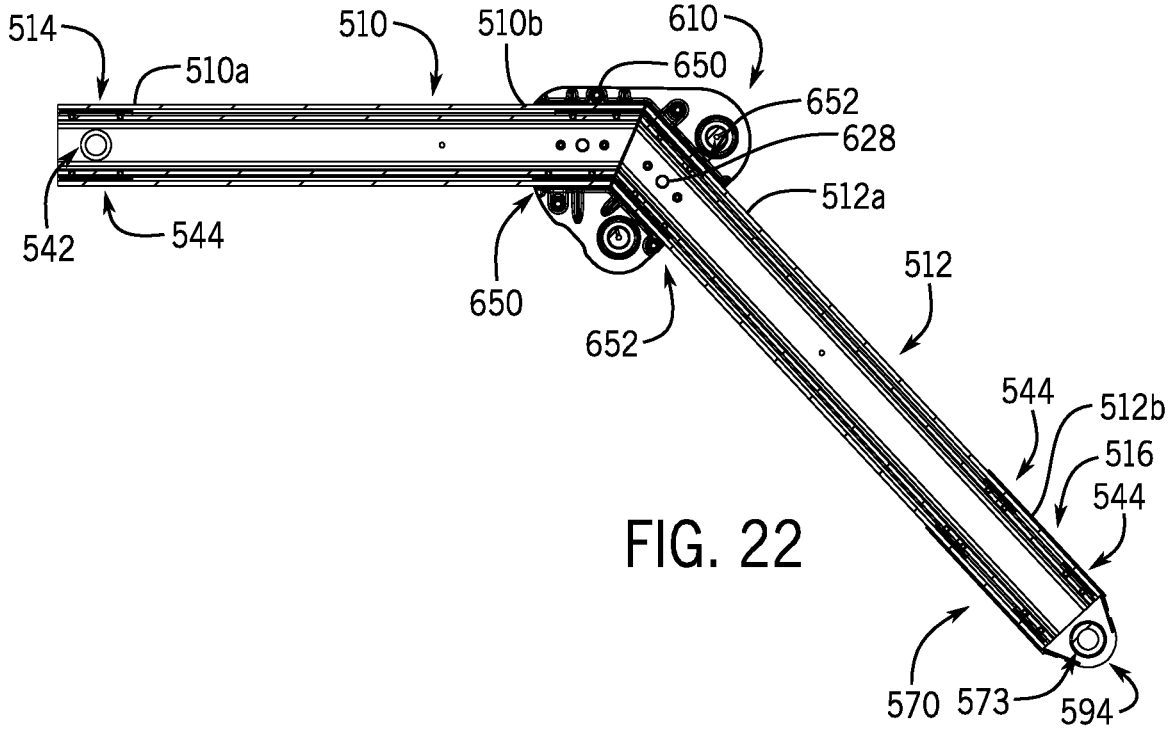
FIG. 22 is a cross-sectional view of one arm assembly of the hybrid loader boom arm assembly, taken along line 22-22 of FIG. 3.

With reference to FIGS. 11 and 12, in order to couple the bucket mount bracket subassembly 518 to the second beam 512 of the second arm assembly 504, with the jacket 576 formed, the bushing 573 is coupled to the retaining flanges 594, via welding. The reinforcing flanges 578 are coupled to the retaining flanges 594, via welding. The second outer jacket 572 is coupled to the jacket 576, via welding, and the supports 574 are coupled between the second outer jacket 572 and the jacket 576, via welding. The intermediate plates 544 are inserted into the fourth end 512*b* of the second beam 512, and the first outer jacket assembly 570 is positioned over the fourth end 512*b*. The mechanical fasteners 550 are inserted through the plurality of bores 592, the first sub-plurality 538*a* of the plurality of bores 538 and into the bores 564 of the intermediate plates 544 to couple the first outer jacket assembly 570 to the second beam 512 (FIG. 14). The mechanical fasteners 550 are also inserted through the plurality of bores 590, the second sub-plurality 538*b* of the plurality of bores 538 and into the bores 564 of the intermediate plates 544 to couple the first outer jacket assembly 570 to the second beam 512 (FIG. 14). This process is repeated to couple the bucket mount bracket subassembly 516 to the second beam 512 of the arm assembly 502 (FIG. 22).

With reference to FIG. 12, with the torque transfer tube 506 formed, in one example, the intermediate plates 544 are inserted into the respective one of the first chamber 522 and the second chamber 524 at the second tube end 506*b*. The second tube end 506*b* is inserted into the second outer jacket 572. The mechanical fasteners 550 are inserted through the plurality of bores 604, the plurality of bores 606 and into the bores 564 of the intermediate plates 544 to couple the second outer jacket 572 to the torque transfer tube 506 (FIG. 14). With reference to FIG. 21, the intermediate plates 544 are inserted into the respective one of the first chamber 522 and the second chamber 524 at the first tube end 506*a*. The first tube end 506*a* is inserted into the second outer jacket 572 of the arm assembly 502. The mechanical fasteners 550 are inserted through the plurality of bores 604, the plurality of bores 606 and into the bores 564 of the intermediate plates 544 to couple the second outer jacket 572 to the torque transfer tube 506.

With the HLBAA 500 assembled, the first end 510*a* of the first beams 510 of the HLBAA 500 may be coupled to the loader 10 (FIG. 1) or the compact utility tractor 1000 (FIG. 1A) via the pin 252 engaging the sleeves 542 of the respective vehicle mounting subassemblies 514. The fourth end 512*b* of the second beams 512 of the HLBAA 500 may be coupled to the respective couplers 74, 76 for coupling the bucket 52 (FIG. 1 or FIG. 1A) to the HLBAA 500 by engaging the coupling pins 80 with each of the bushings 573 of each of the bucket mount bracket subassemblies 516, 518 and the couplers 74, 76. The hydraulic cylinders 34, 36, 38 may also be coupled to the coupling pins 614 of the arm assembly 502 and the second arm assembly 504.

Also, the following examples are provided, which are numbered for easier reference:

1. A hybrid loader boom arm assembly for a loader work vehicle, the loader boom arm comprising: an arm assembly including: a first hollow beam formed from a lightweight material; a second hollow beam formed from the lightweight material; and a connection assembly having a first steel plate and a pair of knee plates formed from the lightweight material, with a portion of the first steel plate received within the first beam at an end and a second portion of the first steel plate received within the second beam at a second end, the pair of knee plates cooperating to define a first channel that receives the end of the first beam and a second channel that receives the second end of the second beam such that the end of the first beam and the second end of the second beam are between the pair of knee plates, the first steel plate and the pair of knee plates configured for interconnecting the first beam with the second beam.

2. The loader boom arm of example 1, wherein the connection assembly includes a second steel plate, with a portion of the second steel plate received within the first beam at the end and a second portion of the second steel plate received within second beam at the second end, the second steel plate configured for interconnecting the first beam with the second beam.

3. The loader boom arm of example 1, wherein the first beam and the second beam have a cross-section that defines a first chamber opposite a second chamber and a third chamber that extends longitudinally between the first chamber and the second chamber, the third chamber having at least one obliquely angled surface.

4. The loader boom arm of example 1, wherein the second beam has a third end opposite the second end, and the arm assembly includes a bucket bracket disposed over the third end, and the bucket bracket is configured for coupling the arm assembly to a bucket of the loader work vehicle.

5. The loader boom arm of example 4, wherein the loader boom arm further comprises a torque transfer tube composed of the lightweight material, and the bucket bracket further comprises a tubular flange that receives an end of the torque transfer tube to couple the torque transfer tube to the second beam.

6. The loader boom arm of example 5, wherein the loader boom arm further comprises a second arm assembly that includes a second bucket bracket, the second bucket bracket having a second tubular flange, and an opposite, second end of the torque transfer tube is received in the second tubular flange to interconnect the arm assembly with the second arm assembly.

7. The loader boom arm of example 1, wherein the first beam includes a fourth end opposite the end, the fourth end defining an opening to receive a sleeve and the sleeve is configured to couple the arm assembly to the loader work vehicle.

8. A method for assembling a hybrid loader boom arm for a loader work vehicle, the method comprising: coupling a first steel plate within an end of a first hollow beam formed from a lightweight material and within a second end of a second hollow beam formed from the lightweight material to form an arm assembly; coupling a first knee plate to the end of the first hollow beam and to the second end of the second hollow beam, the first knee plate defining a first channel portion that receives a portion of the end of the first hollow beam and a second channel portion that receives a portion of the second end of the second hollow beam; coupling a second knee plate to the end of the first hollow beam and to the second end of the second hollow beam, the second knee plate defining a third channel portion that receives a second portion of the end of the first hollow beam and a fourth channel portion that receives a second portion of the second end of the second hollow beam; and interconnecting the first knee plate and the second knee plate.

9. The method of example 8, further comprising: coupling a second steel plate within the end of the first hollow beam and within the second end of the second hollow beam.

10. The method of example 8, further comprising: coupling a bucket bracket over a third end of the second hollow beam, the third end opposite the second end, the bucket bracket configured for coupling the arm assembly to a bucket of the loader work vehicle.

11. The method of example 10, further comprising: coupling a third hollow beam formed from the lightweight material to a fourth hollow beam formed from the lightweight material to form a second arm assembly; and coupling a torque transfer tube to the second hollow beam and the fourth hollow beam.

12. The method of example 8, further comprising: coupling a sleeve to a fourth end of the first hollow beam, the fourth end opposite the end, the sleeve configured for coupling the arm assembly to the loader work vehicle.

13. The method of example 12, further comprising: coupling a pair of lock plates about opposed ends of the sleeve.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A hybrid loader boom arm assembly for a loader work vehicle, the loader boom arm comprising:

an arm assembly including:

a first hollow beam formed from a lightweight material;

a second hollow beam formed from the lightweight material; and a connection assembly having a first steel plate and a pair of knee plates formed from the lightweight material, with a portion of the first steel plate received within the first beam at an end and a second portion of the first steel plate received within the second beam at a second end, the pair of knee plates cooperating to define a first channel that receives the end of the first beam and a second channel that receives the second end of the second beam such that the end of the first beam and the second end of the second beam are between the pair of knee plates, the first steel plate and the pair of knee plates configured for interconnecting the first beam with the second beam.

2. The loader boom arm of claim 1, wherein the connection assembly includes a second steel plate, with a portion of the second steel plate received within the first beam at the end and a second portion of the second steel plate received within second beam at the second end, the second steel plate configured for interconnecting the first beam with the second beam.

3. The loader boom arm of claim 1, wherein the first beam and the second beam have a cross-section that defines a first chamber opposite a second chamber and a third chamber that extends longitudinally between the first chamber and the second chamber, the third chamber having at least one obliquely angled surface.

4. The loader boom arm of claim 1, wherein the second beam has a third end opposite the second end, and the arm assembly includes a bucket bracket disposed over the third end, and the bucket bracket is configured for coupling the arm assembly to a bucket of the loader work vehicle.

5. The loader boom arm of claim 4, wherein the loader boom arm further comprises a torque transfer tube composed of the lightweight material, and the bucket bracket further comprises a tubular flange that receives an end of the torque transfer tube to couple the torque transfer tube to the second beam.

6. The loader boom arm of claim 5, wherein the loader boom arm further comprises a second arm assembly that includes a second bucket bracket, the second bucket bracket having a second tubular flange, and an opposite, second end of the torque transfer tube is received in the second tubular flange to interconnect the arm assembly with the second arm assembly.

7. The loader boom arm of claim 1, wherein the first beam includes a fourth end opposite the end, the fourth end defining an opening to receive a sleeve and the sleeve is configured to couple the arm assembly to the loader work vehicle.

8. A method for assembling a hybrid loader boom arm for a loader work vehicle, the method comprising:

coupling a first steel plate within an end of a first hollow beam formed from a lightweight material and within a second end of a second hollow beam formed from the lightweight material to form an arm assembly;

coupling a first knee plate to the end of the first hollow beam and to the second end of the second hollow beam, the first knee plate defining a first channel portion that receives a portion of the end of the first hollow beam and a second channel portion that receives a portion of the second end of the second hollow beam;

coupling a second knee plate to the end of the first hollow beam and to the second end of the second hollow beam, the second knee plate defining a third channel portion that receives a second portion of the end of the first hollow beam and a fourth channel portion that receives a second portion of the second end of the second hollow beam; and interconnecting the first knee plate and the second knee plate.

9. The method of claim 8, further comprising:

coupling a second steel plate within the end of the first hollow beam and within the second end of the second hollow beam.

10. The method of claim 8, further comprising:

coupling a bucket bracket over a third end of the second hollow beam, the third end opposite the second end, the bucket bracket configured for coupling the arm assembly to a bucket of the loader work vehicle.

11. The method of claim 10, further comprising:

coupling a third hollow beam formed from the lightweight material to a fourth hollow beam formed from the lightweight material to form a second arm assembly; and coupling a torque transfer tube to the second hollow beam and the fourth hollow beam.

12. The method of claim 8, further comprising:

coupling a sleeve to a fourth end of the first hollow beam, the fourth end opposite the end, the sleeve configured for coupling the arm assembly to the loader work vehicle.

13. The method of claim 12, further comprising:

coupling a pair of lock plates about opposed ends of the sleeve.

14. A hybrid loader boom arm assembly kit for a loader work vehicle, the kit comprising:

a first hollow beam formed from a lightweight material;

a second hollow beam formed from the lightweight material;

a first steel plate configured to be received within an end of the first beam and a second end of the second beam; and a pair of knee plates formed from the lightweight material configured to receive the end of the first beam and the second end of the second beam.

15. The kit of claim 14, further comprising:

a second steel plate configured to be received within the end of the first beam and the second end of the second beam.

16. The kit of claim 14, further comprising:

a bucket bracket having a tubular flange, the bucket bracket configured to be coupled about a third end of the second beam.

17. The kit of claim 16, further comprising:

a torque transfer tube composed of the lightweight material, the torque transfer tube configured to be coupled to the tubular flange.

18. The kit of claim 17, further comprising:

a second arm assembly configured to be coupled to the torque transfer tube.

19. The kit of claim 18, further comprising:

a second bucket bracket having a second tubular flange configured to be coupled to an opposite, second end of the torque transfer tube.

20. The kit of claim 14, further comprising:

a sleeve configured to be coupled to a fourth end of the first beam, the fourth end opposite the end.

* * * * *